US006371643B2

(12) United States Patent
Saad et al.

(10) Patent No.: US 6,371,643 B2
(45) **Date of Patent: *Apr. 16, 2002**

(54) MULTI-LAYERED FREEZER STORAGE BAG

(75) Inventors: Zain E. M. Saad, Racine, WI (US); David A. Smith; William D. Price, both of Midland, MI (US); Richard Dawkins, Saginaw, MI (US); Lawrence C. Stanos, Midland, MI (US)

(73) Assignee: S. C. Johnson Home Storage, Inc., Racine, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,474

(22) Filed: Jun. 2, 1999

(51) Int. Cl.[7] ..... B65D 33/16
(52) U.S. Cl. ..... 383/63; 383/38; 383/109
(58) Field of Search ..... 383/38, 63, 101, 383/109, 903, 111, 61, 93, 95, 98, 99, 40, 44, 100; 206/219

(56) References Cited

U.S. PATENT DOCUMENTS

| | | | |
|---|---|---|---|
| 2,638,952 A | 5/1953 | Sanderson | |
| 3,008,862 A | 11/1961 | Haine et al. | |

(List continued on next page.)

FOREIGN PATENT DOCUMENTS

| | | | | |
|---|---|---|---|---|
| CH | 0359659 | * | 2/1962 | ..... 383/44 |
| EP | 0 373 506 A1 | | 6/1990 | |
| EP | 0373748 | * | 6/1990 | ..... 383/93 |
| EP | 0 755 875 A1 | | 1/1997 | |
| FR | 1067272 | * | 6/1954 | ..... 383/109 |
| FR | 1436217 | * | 3/1966 | ..... 383/44 |
| GB | 2097361 A | | 11/1982 | |
| GB | 2228724 A | | 9/1990 | |
| GB | 2273488 A | | 6/1994 | |
| IT | 339640 | * | 11/1936 | ..... 383/109 |
| JP | 0240451 | * | 9/1989 | ..... 383/44 |
| JP | 0267162 | * | 10/1989 | ..... 383/44 |
| JP | 01-294473 | | 11/1989 | |
| JP | 3-226475 | | 10/1991 | |
| JP | 03-289470 | | 12/1991 | |
| JP | 3-289474 | | 12/1991 | |
| JP | 403289450 A | * | 12/1991 | ..... 383/38 |
| JP | 4-31284 | | 2/1992 | |
| JP | 5338639 A | | 12/1993 | |
| NL | 8602848 | * | 6/1988 | ..... 383/38 |
| WO | WO 95/18754 | | 7/1995 | |

OTHER PUBLICATIONS

Hodges, "Rodale's Complete Book of Home Freezing," pp. 2–5 & 173–175 (1984).

Consumer Reports, "Keeping Food Fresh," pp. 143–147 (Mar. 1994).

Jenkins & Harrington, "Packaging Foods With Plastic," J. of Plastic Film & Sheeting, pp. 109–121, 140–149, & 305 (1991).

(List continued on next page.)

*Primary Examiner*—Jes F. Pascua

(57) ABSTRACT

The present invention provides a freezer bag comprising a multi-layered bag having at least one liner film and an outer support bag. The liner film(s) have a first sidewall and a second sidewall attached along respective lateral edges forming edge seals, each sidewall having a top edge, the outer support bag having two sidewalls attached together along respective lateral edges forming edge seals, each sidewall having top edges defining the opening to the multi-layered bag and the support bag having a folded edge defining the bottom of the multi-layered bag, the top edge of at least one liner film being attached to an inner surface of the respective sidewall of the support bag wherein the liner film(s) are thermoplastic.

70 Claims, 14 Drawing Sheets

U.S. PATENT DOCUMENTS 3,282,412 A * 11/1966 Corella et al. ..... 383/44 X
3,494,457 A 2/1970 Titchenal
3,625,348 A 12/1971 Titchenal et al.
3,734,394 A 5/1973 Dooley
3,746,215 A * 7/1973 Ausnit et al. ..... 383/63 X
3,762,628 A * 10/1973 Sargent ..... 383/40
3,844,409 A * 10/1974 Bodolay et al. ..... 383/38 X
3,929,275 A 12/1975 Bolling et al.
3,945,873 A 3/1976 Osborn
3,977,596 A * 8/1976 Gamble ..... 383/95 X
4,172,152 A 10/1979 Carlisle
4,186,786 A 2/1980 Kirkpatrick
4,211,091 A 7/1980 Campbell
4,211,267 A 7/1980 Skovgaard
4,226,330 A * 10/1980 Butler ..... 206/219 X
4,256,256 A * 3/1981 Meyers ..... 383/40
4,323,586 A 4/1982 Long
4,358,466 A 11/1982 Stevenson
4,411,919 A 10/1983 Thompson
4,428,788 A 1/1984 Kamp
4,479,010 A 10/1984 Coelho
4,481,669 A 11/1984 Pezzana et al.
4,540,089 A * 9/1985 Maloney ..... 383/38 X
4,691,368 A * 9/1987 Roessiger ..... 383/93 X
4,735,308 A 4/1988 Barner
4,741,789 A 5/1988 Zieke et al.
4,743,123 A 5/1988 Legters et al.
4,758,099 A * 7/1988 Branson ..... 383/44
4,861,632 A 8/1989 Caggiano
4,890,936 A 1/1990 Cooper
4,925,316 A * 5/1990 Van Erden et al. ..... 383/61
4,951,666 A 8/1990 Inman et al.
4,993,844 A 2/1991 Robinson et al.
5,005,679 A 4/1991 Hjelle
5,020,922 A 6/1991 Schirmer
5,049,223 A 9/1991 Dais et al.
5,108,814 A 4/1992 Harp et al.
5,140,845 A 8/1992 Robbins
5,176,251 A 1/1993 Davis et al.
5,256,428 A 10/1993 Lustig et al.
5,281,027 A 1/1994 Thrall
5,302,402 A 4/1994 Dudenhoeffer et al.
5,310,587 A 5/1994 Akahori et al.
5,328,705 A 7/1994 Wilhoit et al.
5,360,648 A 11/1994 Falla et al.
5,372,429 A 12/1994 Beaver, Jr. et al.
5,376,439 A 12/1994 Hodgson et al.
5,405,561 A 4/1995 Dais et al.
5,419,448 A 5/1995 Watson
5,779,894 A * 7/1998 Martensson ..... 383/38 X
5,803,256 A * 9/1998 Lydhig et al. ..... 383/40 X
5,804,265 A 9/1998 Saad et al.
5,911,508 A * 6/1999 Dobreski et al. ..... 383/63 X
5,965,224 A 10/1999 Chen et al.
5,988,879 A * 11/1999 Bredderman et al. ..... 383/95 X
6,065,873 A * 5/2000 Fowler ..... 383/93 X
6,156,363 A 12/2000 Chen et al.

OTHER PUBLICATIONS

U.S. Dept. of Agriculture, "Home Freezing of Fruits and Vegetables," Home and Garden Bulletin No. 10 (1969).

ZIPLOC® Freezer Bags For Meat, an example of a visual concept evaluated by consumers (1995).

Webster's Third New International Dictionary, p. 1486., No date.

EM Material Safety Data, Polymer Films Inc. (Jun. 1986).

* cited by examiner

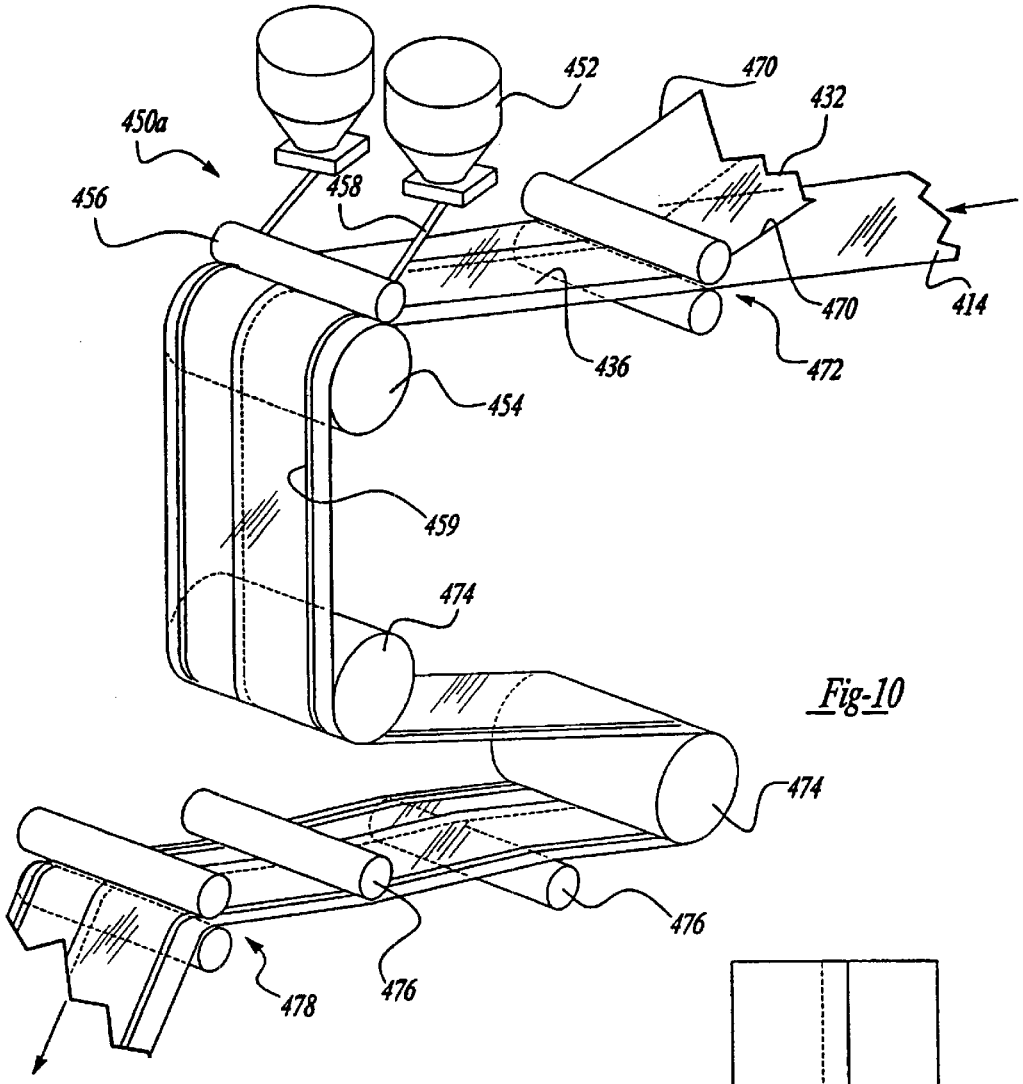
Fig-10
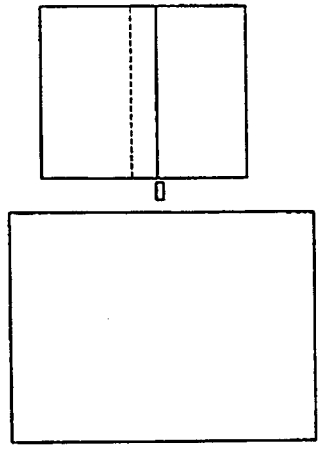
Fig-10a
Fig-10b
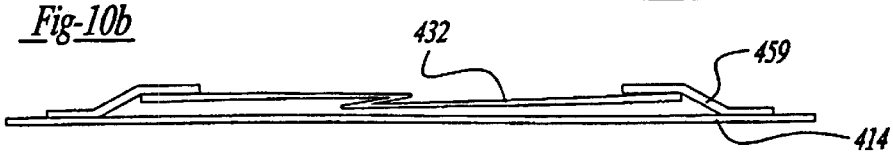

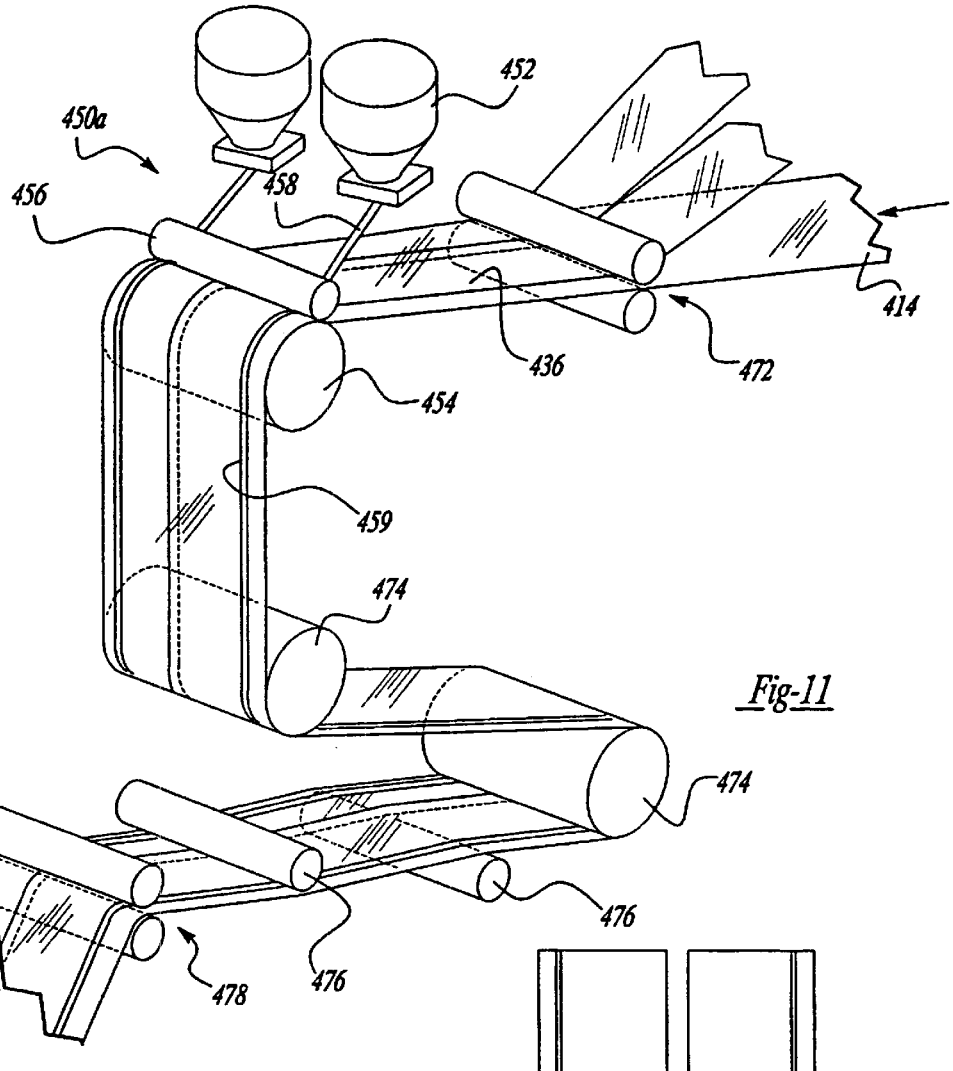
Fig-11
Fig-11a
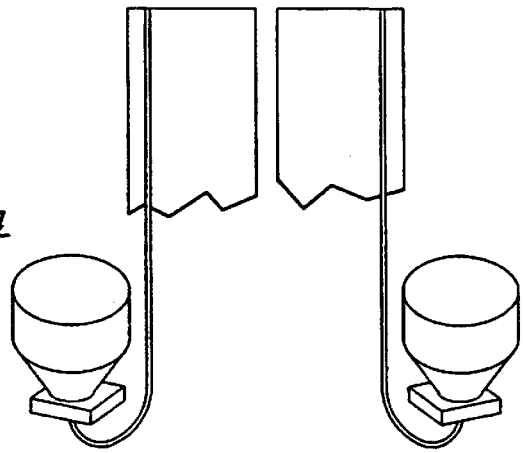
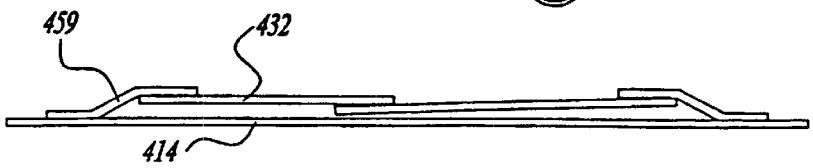
Fig-11b

MULTI-LAYERED FREEZER STORAGE BAG

BACKGROUND OF THE INVENTION

The invention generally concerns the packaging of food, particularly meat. The invention was made during attempts to make improved functional "freezer bags" for repackaging and freezer storing uncooked red meat by the ultimate consumer in a manner that reduces so called "freezer burn". Other aspects of the invention include methods for preparing the freezer bags and materials and methods for using the bags, for example.

Reclosable plastic storage bags are relatively old in the art. Today, plastic bags are typically available to the public in cartons identified for specific recommended "end use" (such as Storage Bags, Heavy Duty Freezer Bags, Vegetable Bags, Trash Bags). Often the bag itself is labeled by "end use", e.g., "ZIPLOC® BRAND Heavy Duty Freezer Bags".

The term "freezer bag" is hereby defined as a bag having significant functional utility in the storage of food in a freezer. "Freezer Bags" are typically available in the following sizes: 2 gallon; 1 gallon; pleated ½ gallon; quart; and pint.

The term "freezer burn" is hereby defined as the name for the dehydration that occurs when unpackaged or improperly packaged food is stored in the low humidity atmosphere of a freezer (see "Packaging Foods With Plastics", by Wilmer A. Jenkins and James P. Harrington, published in 1991 by Technomic Publishing Co., In., at page 305). Consumers typically describe freezer burn in terms of three main visual attributes: ice crystal formation, product dehydration and color change.

Freezer burn has remained a major complaint among consumers despite the commercial success of thick plastic freezer bags. In the short term, freezer burn can be a reversible process. In the long term, however, freezer burn causes a complex deterioration of food quality involving undesirable texture changes followed by chemical changes such as degradation of pigments and oxidative rancidity of lipids. Taste, aroma, mouth feel and color can all be ruined. Freezer burn of raw red meat is particularly critical because of its impact upon the color of the meat.

Aforementioned "Packaging Foods With Plastics" provides an excellent state of the art summary, with information on (commercial) packaging fresh red meat collected in chapter seven. Curiously, the book does not appear to mention freezer burn, apart from defining it in the glossary.

Additional reference information is provided in "Keeping Food Fresh", an article in "Consumer Reports" for March 1994, at pages 143–147. The article contains a general overview of food storage products. More particularly, the article attempts to answer questions as to which packaging material (plastic, aluminum, waxed paper, bags, wraps or reusable containers) do the best job of (1) keeping food fresh for "the long haul", (2) at lowest overall cost, and (3) with minimum adverse environmental impact. It "top rates" ZIPLOC® Pleated Freezer Bags (at page 145). It points out that food stored in plastic containers can suffer from freezer burn if the container contains too much air. Concerning "wraps" (plastic films and freezer papers), interestingly it advised against double wrapping because of cost and environmental reasons and it was noted that tests showed that double wrapping doesn't afford much extra protection anyway.

The patent literature contains descriptions of various types of bags having liners or double walls including some space between the walls. Some of these patents relate to the transportation and storage of food. U.S. Pat. No. 4,211,091 (Campbell) concerns an "Insulated Lunch Bag". U.S. Pat. No. 4,211,267 (Skovgaard) describes a "Carrying Bag" for "getting home with frozen food before it thaws". U.S. Pat. No. 4,797,010 (assigned to Nabisco Brands) discloses a duplex paper bag as a "reheatable, resealable package for fired food". U.S. Pat. No. 4,358,466 (assigned to The Dow Chemical Company) relates to an improved "Freezer to Microwave Oven Bag". The bag is formed of two wing shaped pouches on each side of an upright spout. U.S. Pat. No. 5,005,679 (Hjelle) concerns "Tote Bags Equipped With A Cooling Chamber". All of these food bags appear to have very thick food contacting walls compared to the invention described hereinafter. None of these patents appear to focus on freezer burn.

A more recent development in the art is disclosed in U.S. Pat. No. 5,804,265 which is assigned to S.C. Johnson Home Storage, Inc. This patent discloses an unique bag within a bag design specifically intended, although not limited in use, to controlling freezer burn. While tests show that this bag within a bag embodiment is clearly an advancement over other known storage bags, improvements in terms of product efficiency and material cost savings, among others, are desirable.

SUMMARY OF THE INVENTION

In its broadest scope, the present invention provides a freezer bag comprising a multi-layered bag including an outer support bag and an inner liner. The outer support bag includes two sidewalls attached together along respective lateral edges forming edge seals, said sidewalls having top edges which define an opening to the multi-layered bag and a folded edge defining the bottom of the multi-layered bag. The inner liner generally includes at least one sidewall which is attached along at least one edge to an inner surface of the respective sidewall of the outer support bag. The inner liner also includes at least one free or discontinuous edge as opposed to all closed edges which gives rise to an inner bag.

The present invention further relates to a process for making multi-layered bags having an outer support bag and at least one inner liner comprising the steps of forwarding a first thermoplastic film having a first thickness and a first transverse web width, forwarding a second thermoplastic film including two separate sheets having a second total thickness and a second total transverse web width, the second transverse web width being smaller than the width of the first thermoplastic film, overlaying the second thermoplastic film onto the first thermoplastic film between the edges of the first film, attaching the second thermoplastic film to the first thermoplastic film, folding the films in the transverse direction and seal cutting the folded films to form a multi-layered bag.

The present invention also relates to a process for making multi-layered bags having an outer support bag and at least one inner liner comprising the steps of forwarding a first thermoplastic film having a first thickness and a first transverse web width, forwarding a second thermoplastic film including two separate sheets, the second film preferably having a second thickness and a second transverse web width which is smaller than the width of the first thermoplastic film, perforating or slitting the second thermoplastic film, overlaying the second thermoplastic film onto the first thermoplastic film between the edges of the first film, attaching the second thermoplastic film to the first thermoplastic film, folding the films in the transverse direction and seal cutting the folded films to form a multi-layered bag.

Another process in accordance with the teachings of the present invention relates to heat sealing at least two film webs comprising the steps of providing at least first and second film including at least one sheet, the webs capable of being heat sealed together, perforating or slitting the second thermoplastic film, overlaying the second film web onto the first film web, providing at least one sealing band of material having a temperature, mass and heat capacity sufficient to heat seal the second thermoplastic film to the first thermoplastic film and applying the band of sealing material to the overlaid film webs. Preferably, the band seal is compressed between rollers after having been applied.

Yet another process in accordance with the present invention relates to heat sealing at least two film webs comprising the steps of providing at least a first film and a second film including multiple sheets, said webs capable of being heat sealed together, perforating or slitting the second thermoplastic film, overlaying the multiple sheets of the second film web onto the first film web, providing at least one sealing band of material having a temperature, mass and heat capacity sufficient to heat seal the second thermoplastic film to the first thermoplastic film and applying the band of sealing material to the overlaid film webs. Preferably, the band seal is compressed between rollers after having been applied.

Further according to the present invention, there is a process for attaching at least two film webs comprising the steps of providing at least first and second film webs having first and second widths respectively, perforating or slitting the second film web, overlaying the second film web onto the first film web between parallel edges of the first film web, providing at least one sealing band of material capable of being heat sealed to at least a portion of both film webs and applying the sealing band of material along and over parallel edges of the second film web.

Still another process according to the teachings of the present invention relates to a process for attaching at least two film webs comprising the steps of providing at least a first film web having a first web width and a second film including multiple sheets wherein the total of the multiple sheets gives a second web width, perforating or slitting the second film web, overlaying the multiple sheets of the second film web onto the first film web between parallel edges of the first film web, providing at least one sealing band of material capable of being heat sealed to at least a portion of both film webs and applying said sealing band of material along and over parallel edges of the second film web.

Further according to the present invention is an apparatus for making multi-layered bags having an outer support bag and at least an inner liner comprising means for forwarding a first thermoplastic film web having a first thickness and a first transverse web width between parallel edges, means for forwarding a second thermoplastic film web having a second thickness and a second transverse web between parallel edges, means for perforating or slitting said second thermoplastic film, and if necessary adjusting the width of the second web to be smaller than the width of the first web, means for overlaying the second thermoplastic film web onto the first thermoplastic film web between the parallel edges of the first film web, means for attaching the second thermoplastic film web to the first thermoplastic film web along parallel edges of the second thermoplastic film, means for folding the films in the transverse direction and means for seal cutting the folded films to form multi-layered bags.

Further according to the present invention there is an apparatus for attaching at least two film webs comprising means for providing at least a first film web having a first web width and a second film web including multiple sheets wherein the total of all the sheets gives a second web width, having first and second widths respectively, means for overlaying the second film web onto the first film web, means for providing at least one sealing band of material capable of being heat sealable to at least a portion of both film webs and means for applying the sealing band of material along and over parallel edges of the second film web.

BRIEF DESCRIPTION OF THE DRAWINGS

FIG. 10 is an isometric view of another apparatus for preparing and blanket sealing multi-layered bags of the present invention;

FIG. 10*a* is a topographical view of the first and second webs of a multi-layered bag produced via the apparatus of FIG. 10;

FIG. 10*b* is a sectional view of the multi-layered bag panel produced via the apparatus of FIG. 10;

FIG. 11 is an isometric view of yet another apparatus for preparing and blanket sealing multi-layered bags of the present invention;

FIG. 11*a* is a topographical view illustrating the second web as two separate sheets;

FIG. 11*b* is a sectional view of the multi-layered bag panel produced via the apparatus of FIG. 11;

DETAILED DESCRIPTION OF THE INVENTION

Figure 1A:
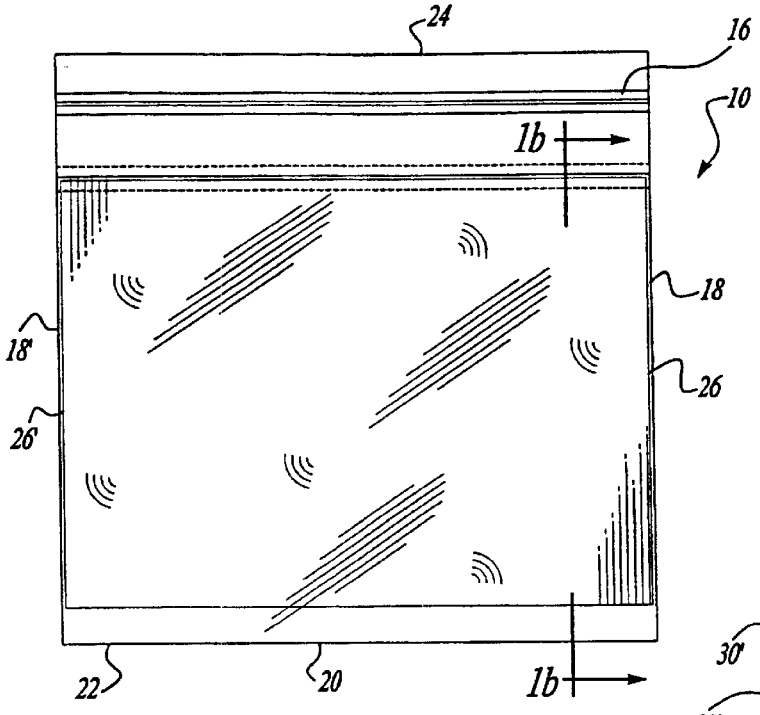
FIG. 1*a* is a front elevational view of a first reclosable multi-layered bag embodiment.

Referring to FIGS. 1*a*–1*e*, a multi-layered bag in accordance with the teachings of the present invention is shown. The multi-layered bag 10 generally comprises an outer bag 12 and an inner liner 14. The outer bag 12 is defined by side sealed edges 18 and 18' as well as a folded edge 20 occurring along a first end (bottom) 22 of the outer bag. Provided along a second end (top) 24 of the outer bag is a reusable closure 16, including, for example, mating male and female members, for releasably closing the multi-layered bag. The inner liner 14 includes side edges 26 and 26', which according to the embodiment of FIG. 1*a*, share a common edge seal with the outer bag as illustrated by reference numerals 18 and 18'. Optionally, the side edges 26 and 26' of the inner liner may be sealed separately from the side edges of the outer base as demonstrated in FIG. 1*e*.

Figure 1B:
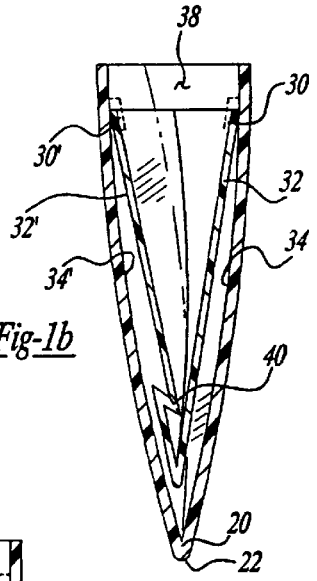
FIG. 1*b* is a cross-sectional view taken along line 1*b*—1*b* of FIG. 1*a* including a perforated inner liner.
Figure 1C:
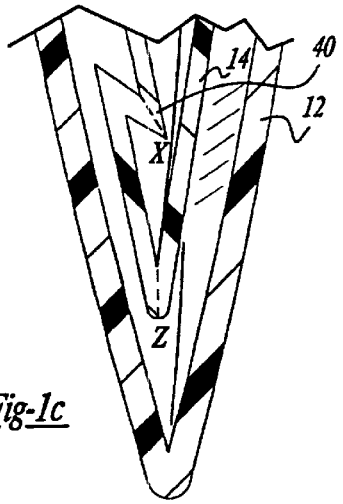
FIG. 1*c* is a magnified view of the inner liner of FIG. 1*b;*
Figure 1D:
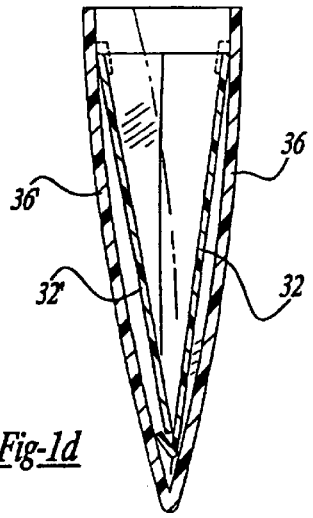
FIG. 1*d* is a cross-sectional view of the inner liner of FIG. 1*a* after tearing along the perforations.
Figure 1E:
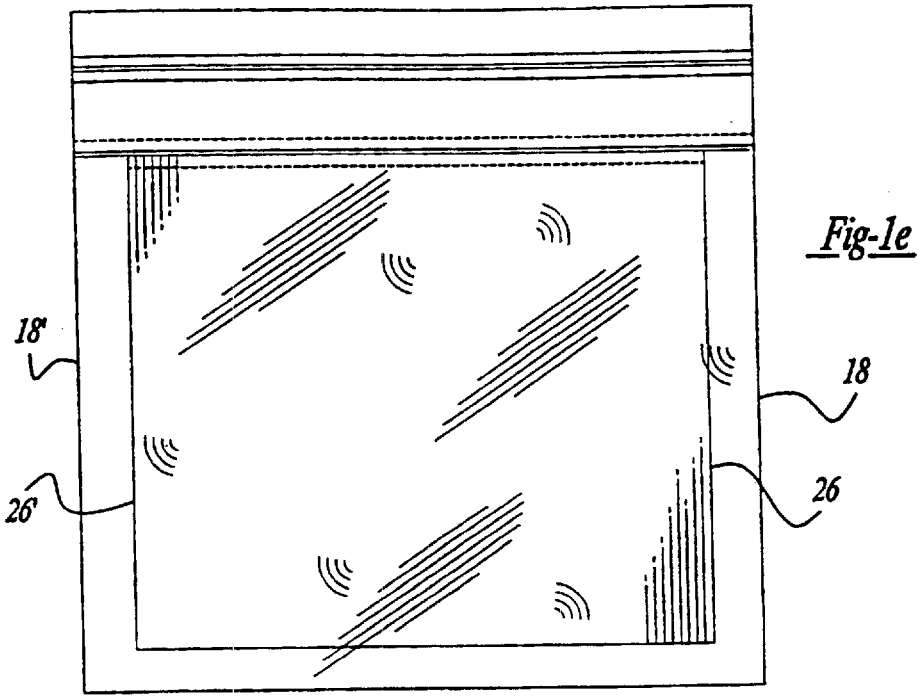
FIG. 1*e* is a first elevational view of an alternative embodiment of FIG. 1*a;*

Referring particularly to FIGS. 1*b* and 1*d*, the inner liner 14 includes two sidewalls 32 and 32' which are formed upon slitting the inner liner 14, the first ends 30 and 30' of the two sidewalls 32 and 32' are sonically welded or otherwise attached to the inner surfaces 34 and 34' of the outer bag 12. As illustrated, while not required, it is preferable that the sidewalls 32 and 32' generally extend almost the entire length of the multi-layered bag 10.

Referring to FIG. 1*c*, the inner liner is shown to be perforated at lateral lines X and Z occurring along the crotch 40 such that upon exerting sufficient pressure on the inner liner, the liner is torn along at least one of the perforation lines such that the sidewalls 32 and 32' are no longer continuous as shown most clearly with reference to FIG. 1*d*.

As shown in various figures, the inner liner is generally separable from the side walls 36 and 36' of the outer bag 12 except for those embodiments wherein common edge seals are employed. As will be illustrated with regard to additional figures contained herein, as the closure 16 is pulled apart to form an opening 38, foodstuffs are placed into the multi-layered bag between the sidewalls 32 and 32'.

Among the numerous closures 16 which may be employed, examples of preferred reusable closures and information on their manufacture can be found in U.S. Pat. Nos. 4,561,109; 4,363,345; 4,528,224; 5,070,854 and 5,804,265, each of which is hereby incorporated by reference. Other possible closure systems include adhesives hook and loop-type fasteners, (e.g., VELCRO®), mechanical closures, slide lock closures, draw string with string or tape, fold lock top, magnetic closures, dead fold closures (i.e., aluminum foil, wire folded, tape), heat seals, staples, handle strings, cable ties or twist ties, among others.

Interestingly, by tearing the inner liner along the perforations, pre-slitting the inner liner or forming the inner liner or web from multiple sheets as will be described in greater detail below, vent holes which were noted as being preferable according to U.S. Pat. No. 5,804,265, can be eliminated. As such, air which can be trapped between the inner and outer bags of the aforementioned patent is no longer a concern.

Referring to FIGS. 2*a*–2*e*, an alternative multi-layered bag in accordance with the teachings of the present invention is shown. It should be noted that the same reference numerals will be utilized for identical components described under the embodiments of FIGS. 1*a*–1*e* and 2*a*–2*e*, respectively.

Figure 2A:
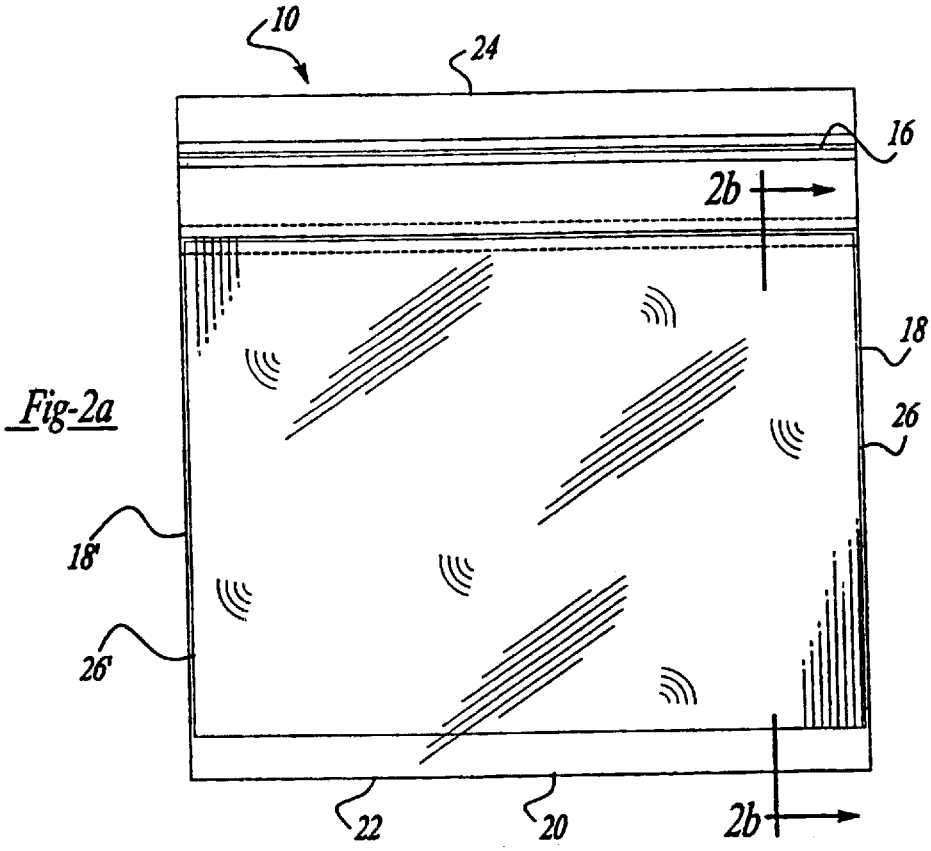
FIG. 2*a* is a front elevational view of a second reclosable multi-layered bag embodiment.
Figure 2B:
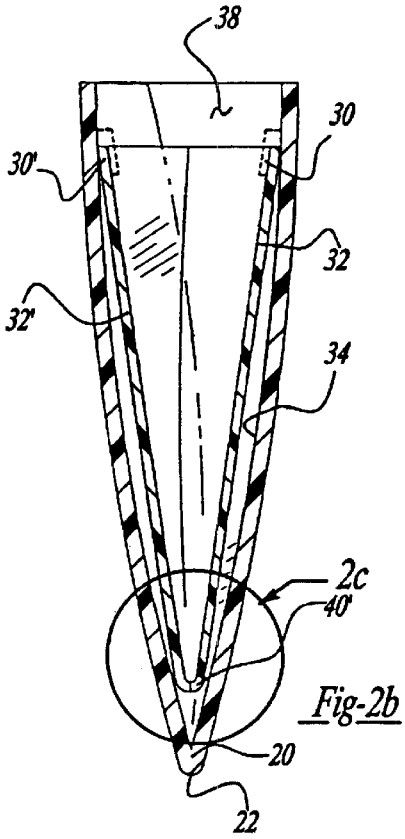
FIG. 2*b* is a cross-sectional view taken along line 2*b*—2*b* of FIG. 2*a* including a perforated inner liner.
Figure 2C:
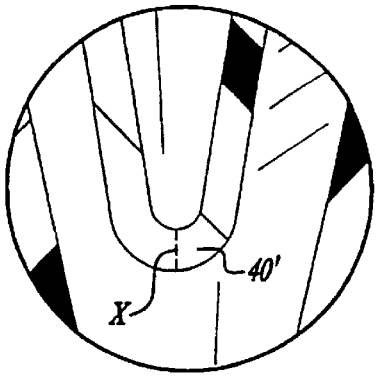
FIG. 2*c* is a magnified view of the inner liner of FIG. 2*a;*
Figure 2D:
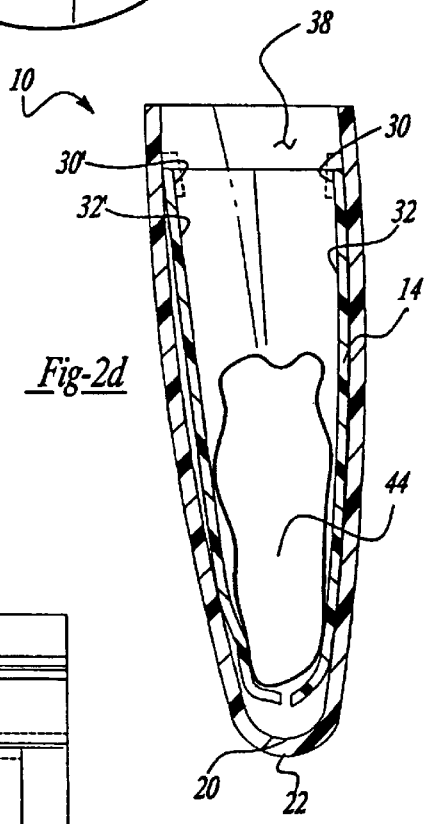
FIG. 2*d* is a cross-sectional view of the inner liner of FIG. 2*a* after tearing along the perforations.
Figure 2E:
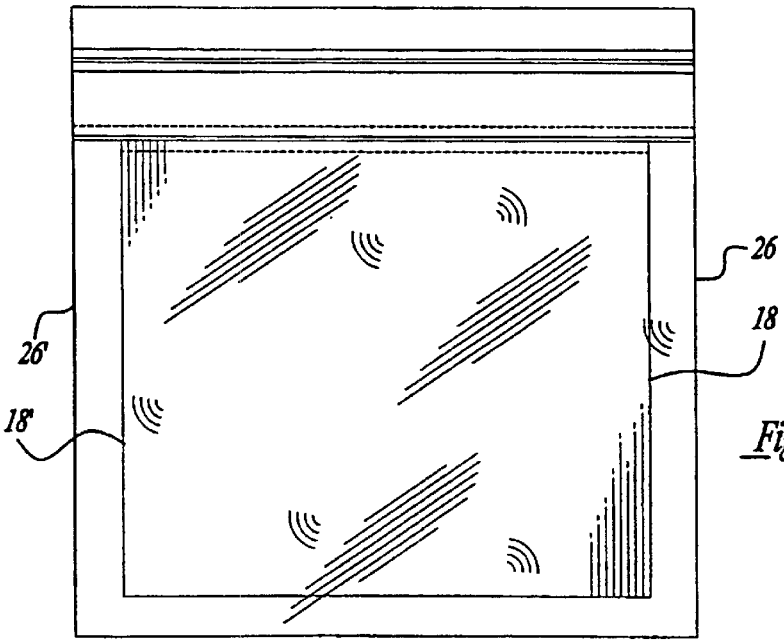
FIG. 2*e* is a front elevational view of an alternative embodiment of FIG. 2*a;*

In essence, the only difference between the embodiments of FIGS. 1*a*–1*e* and those of FIGS. 2*a*–2*e* lie in the construction of the crotch 40 of each embodiment. As illustrated with reference to FIGS. 2*b* and 2*c*, the crotch 40' includes a single lateral perforation line X. In contrast, the crotch 40 of FIGS. 1*a*–1*e* includes multiple lateral perforation lines X and Z respectively, provided along an excess of inner liner material. As shown in FIGS. 2*a* and 2*e*, the lateral side seals between the outer bag and inner liner, if present, may be common or spaced apart.

By inserting foodstuff 44 through the opening 38 as shown most clearly in FIG. 2*d*, the perforation line X becomes torn to provide the separated sidewalls 32 and 32' of the inner liner 14. Depending on the shape of the foodstuff, the first end 22 of the multi-layered bag 10 will generally conform to the shape of the foodstuff, i.e., become more rounded.

Figure 3A:
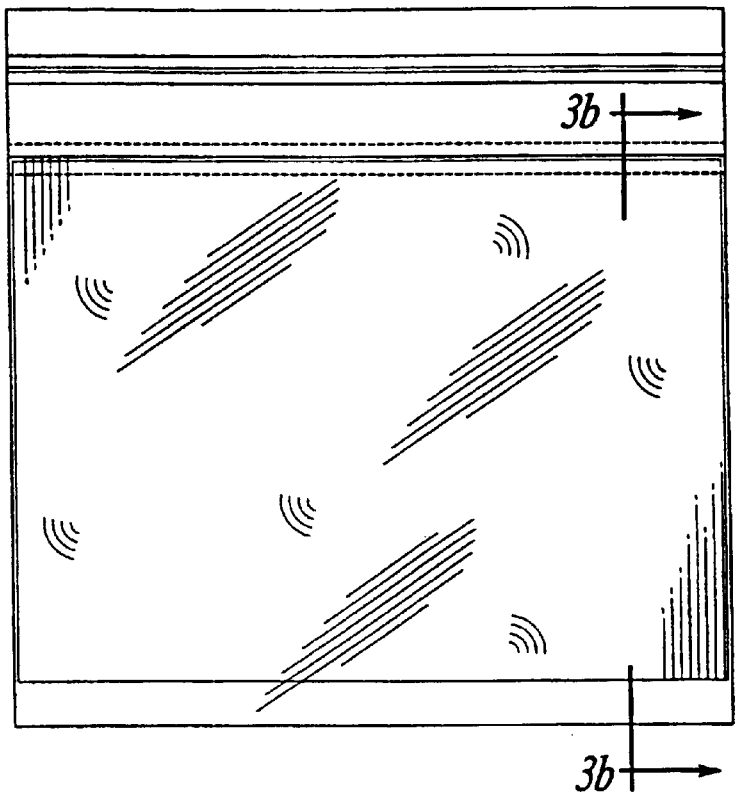
FIG. 3*a* is a front elevational view of a third reclosable multi-layered bag embodiment.
Figure 3B:
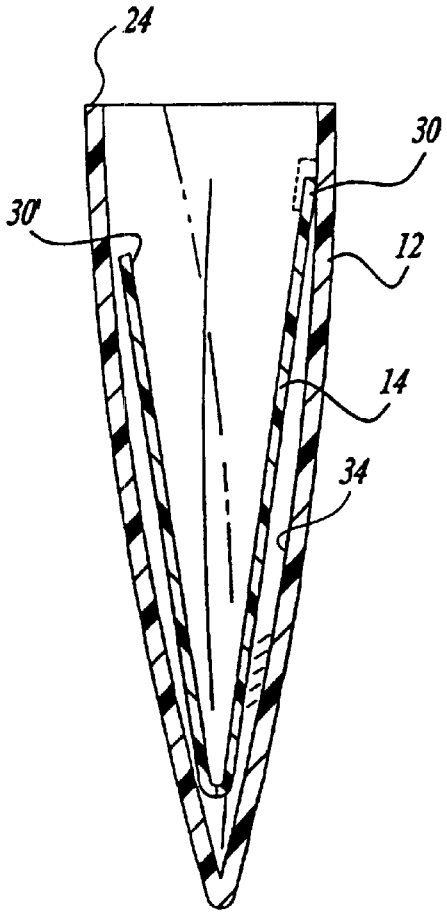
FIG. 3*b* is a cross-sectional view taken along line 3*b*—3*b* of the multi-layered bag of FIG. 3*a;*
Figure 3C:
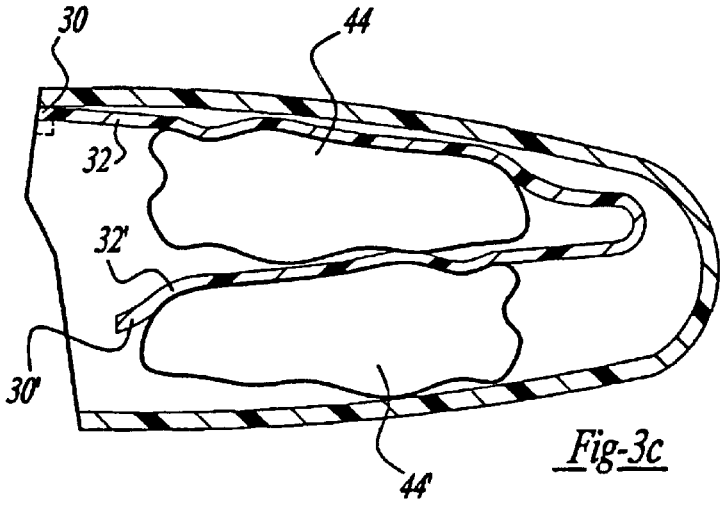
FIG. 3*c* is a cross-sectional side view of the bag of FIG. 3*a* including two pieces of meat separated by the inner liner.

Referring to FIGS. 3*a*–3*c*, still another multi-layered bag in accordance with the teachings of the present invention is illustrated. The outer bag 12 is essentially the same as disclosed with regard to the previously discussed embodiments. However, first end 30 of the inner liner 14 is the only portion which is attached to the inner surface 34 of the outer bag. The other first end 30' is free standing. The length of the inner liner is sufficiently long so that first end 30' of the inner liner approaches the second end 24 of the multi-layered bag. By providing an elongated continuous inner liner 14 as shown most clearly with reference to FIG. 3*c*, multiple foodstuff pieces 44 and 44' can be inserted into the bag wherein the foodstuff pieces are separated by sidewall 32'. Under this embodiment, it is preferable that the foodstuff be stored with the bag laying horizontally with the sidewall 36 of the outer bag being disposed against the refrigerator or freezer bottom (not shown). By disposing the multi-layered bag of FIGS. 3*a*–3*c* in this manner, the inner liner 14 may substantially conform to the shape of the foodstuffs thereby protecting against undesirable conditions such as freezer burn, for example.

Figure 4A:
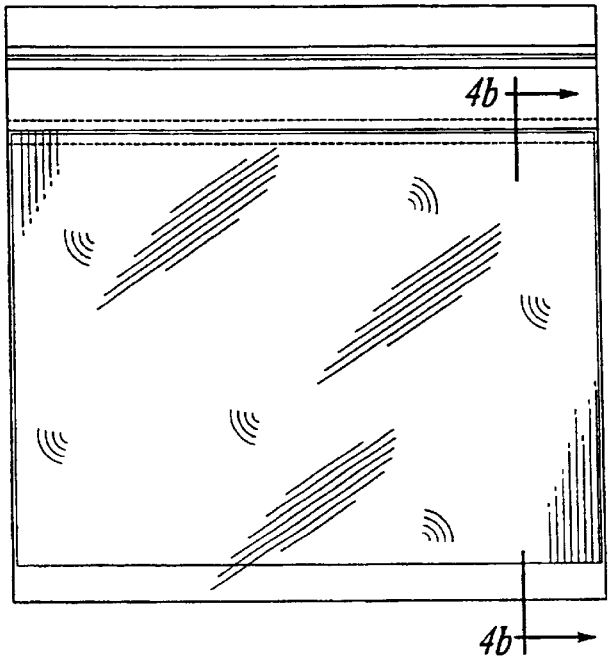
FIG. 4*a* is a front elevational view of a fourth reclosable multi-layered bag embodiment.
Figure 4B:
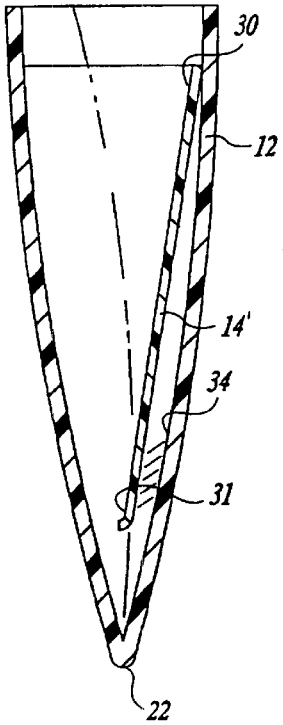
FIG. 4*b* is a cross-sectional view taken along line 4*b*—4*b* of the multi-layered bag of FIG. 4*a;*
Figure 4C:
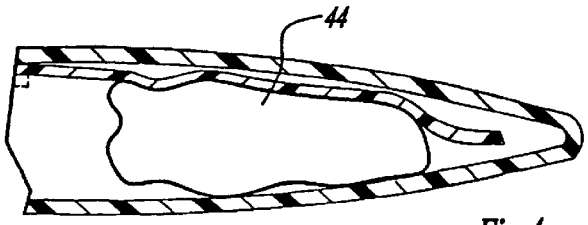
FIG. 4*c* is a cross-sectional side view of the bag of FIG. 4*a* including a piece of meat.

Referring to FIGS. 4*a*–4*c*, a still further embodiment of the multi-layered bag is shown. Disposed within outer bag 12 is a truncated inner liner 14' which is attached along a first end 30 to the inner wall 34 of the outer bag. The free end 31 of the inner liner terminates in proximity to the first end (bottom) 22 of the outer bag. Again, by disposing the bag in a horizontal position, the truncated inner liner 14' may conform generally to the shape of the foodstuff 44 which is highly desirable. While FIG. 4*a* illustrates that the truncated inner liner 14' may share a common side seal along one or both sidewalls with the outer bag, it is also possible that the truncated inner liner 14' suspends freely within the outer bag excepting for the attachment along the first end 30.

Figure 5A:
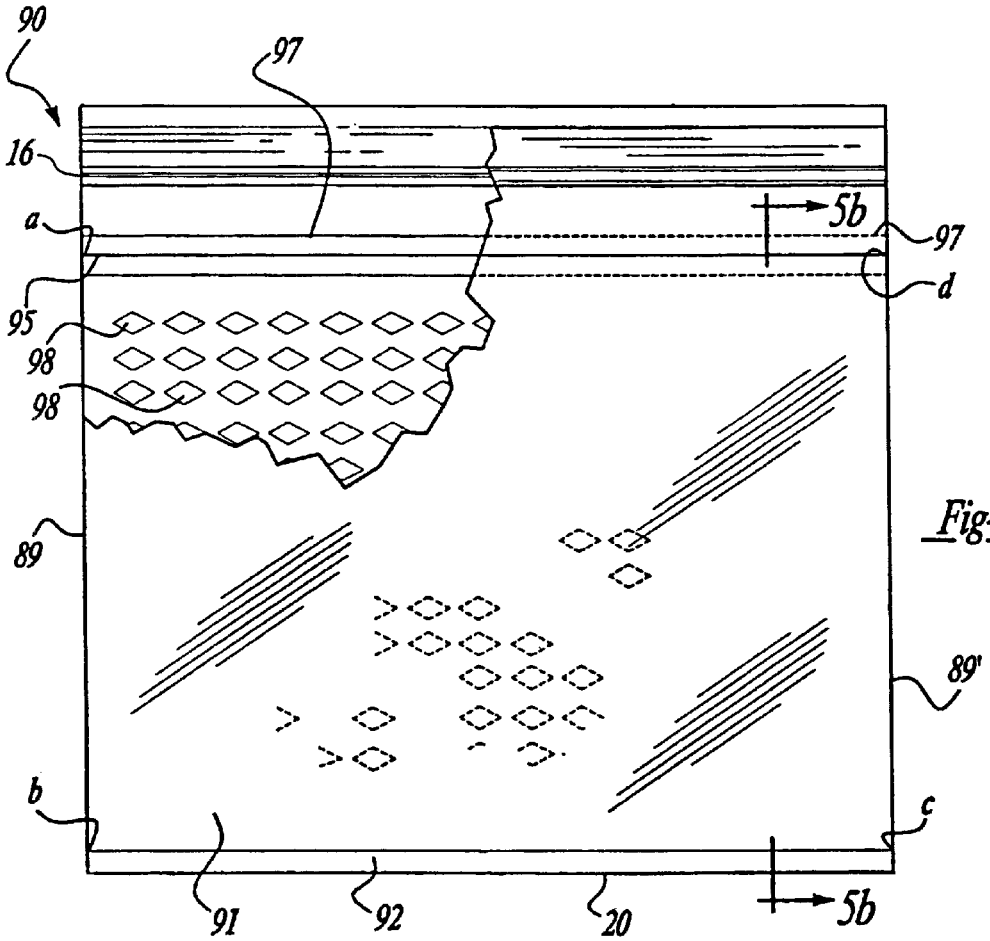
FIG. 5*a* is a front elevational view of a multi-layered bag having a textured inner liner.
Figure 5B:
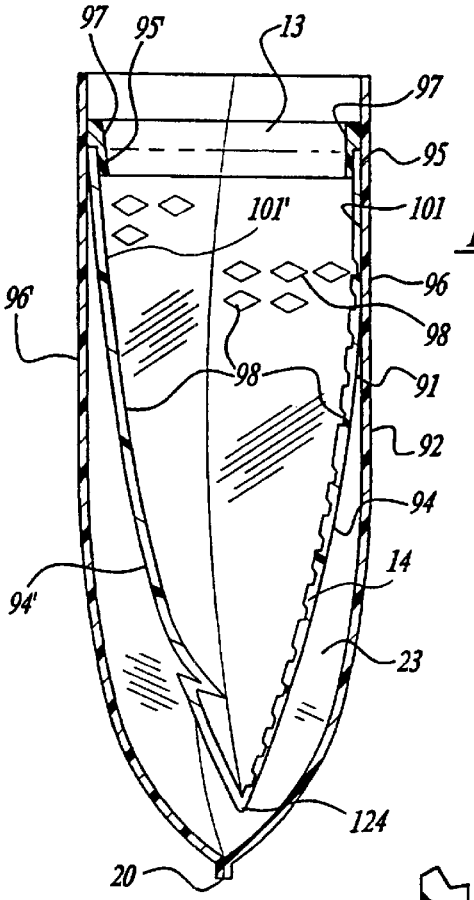
FIG. 5*b* is a cross-sectional view taken along line 5*b*—5*b* of FIG. 5*a;*

Referring to FIGS. 5*a* and 5*b*, a preferred embodiment of the multi-layered bag 90 in accordance with the teachings of the present invention is shown. According to this embodiment, the multi-layered bag 90 is comprised of an inner liner 91 and an outer bag 92 having a reusable closure means 16. Inner liner 91 is defined by edges ad, cd, ab, and bc. Outer bag 92 is defined by edge seals 89, 89' and folded edge 20. Inner liner 91 and outer bag 92 share edge seals ab and cd. Referring to FIGS. 5*a* and 5*b*, top edges 95, 95' of inner liner 91 are attached to sidewalls 96, 96' of outer bag 92 laterally across inside surface 101, 101' by a blanket seal 97 in the machine direction. Top edges 95, 95' attached to outer bag sidewalls 96, 96' define the liner bag opening. Inner liner sidewalls 94, 94' and outer bag sidewalls 96, 96' are generally separable except at edge seals ab, cd, and blanket seal 97 (described hereinafter) forming a space 23 therebetween as shown in FIG. 5*b*. Inner liner 91 preferably has textured inner surfaces 98 as shown in FIGS. 5*a* and 5*b*. Preferably, the textured surfaces 98 are embossed. By texturing or embossing the film of the inner liner, the liner exhibits improved performance attributed to an increase in the surface area of the film which in turn provides greater cling to the foodstuff surface than is exhibited by a smooth film. Additionally, this texturing or embossing effectively reduces the overall stiffness of the inner liner which improves cling as well. Among the numerous patterns and shapes which are available: diamonds, honeycombs, squares, spheres, triangles, cones, pyramids and the like as illustrated with reference to FIGS. 6*a*–6*f* have demonstrated good performance. The textured or embossed patterns as herein described also provide channeling of air away from the foodstuff as the inner liner comes in contact with the foodstuff, thus further conforming to the shape of the foodstuff. The density of the textured elements which are typically in a specific pattern may be from about 6 to 50 units per linear inch of the surface of the inner liner and preferably from about 10 to about 20 units per linear inch of the surface of the liner. The textured surfaces will generally include a plurality of protrusions which extend inwardly. Various geometrically shaped protrusions are further illustrated with reference to FIGS. 6*a*–6*f*.

The method of attaching the inner liner to the outer bag may be any method which is known in the art, i.e., mechanical and/or adhesive, for example. The inner liner may, for example, be attached continuously and uniformly along the top edges or attached in a discontinuous or intermittent manner along the top edges. Useful examples of attaching the inner liner include by way of non-limiting example, hot air seam sealing, extrusion lamination, heated bar heat sealing, ultrasonic sealing, heated rollers or belt, adhesive film strips, infrared scaling, radio frequency sealing or vibration welding, by way of non-limiting example. The inner liner may also be attached to the support bag during manufacture by post applying closure profiles onto and over edges of the inner liner. A hinge type blanket seal is illustrated with reference to FIGS. 5*c* and 5*d*.

Figure 5C:
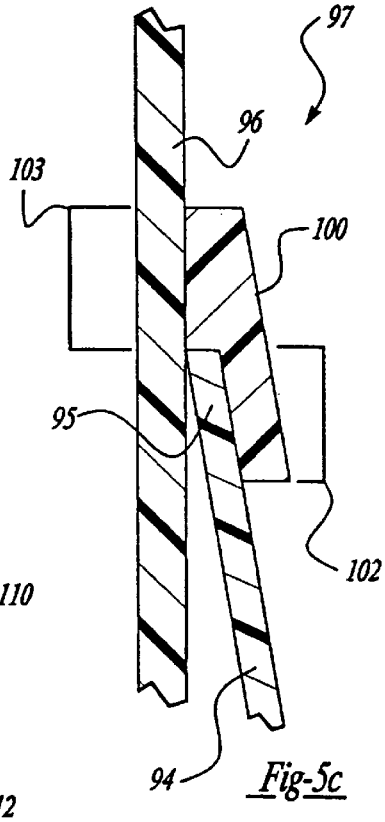
FIG. 5*c* is an enlarged cross-sectional view of a blanket seal for attaching the top edges of the liner bag to the sidewalls of the support bag.

As shown more particularly in FIG. 5*c*, a hinge-type blanket seal 97 is formed by overlapping a sealing band 100 of extruded material over the top edges 95 of the inner liner sidewall 94 in the machine direction of the inner liner and outer bag film. The process of applying a sealing band and forming a blanket seal is described hereinafter. The sealing band 100 is attached to the outer bag sidewalls generally at area 103 and is attached to the inner liner edges generally at area 102. The top edges of the inner liner are not heat sealed to the outer bag sidewalls in this embodiment. Attaching sealing band 100 to both sidewall 96 and top edge 95 creates a hinge-like attachment whereby the top edge may be pulled away from sidewall 96 and form a T-shape at the point of attachment. The strength of the attachment of the sealing band to the outer bag and the inner liner is preferably such that the inner liner film will fail during a T-shape pull test. The sealing band 100 used to form a hinge-type blanket seal may be made from any suitable thermoplastic material or combination of thermoplastic materials that are heat sealable to at least the portion of the thermoplastic films to be joined. Preferably, the sealing band is polyethylene and more preferably, low density polyethylene or other materials which are compatible with the outer bag and inner liner materials hereinafter described.

Another type of blanket seal useful in the present invention is a blanket seal which attaches to both the outer bag and inner liner materials and also causes the inner liner material to heat seal to the outer bag. As shown in FIG. 9*d*, heat seal type blanket seal 110 comprises sealing band 112 applied over the top edges 95 of the inner liner sidewall 94 and contacting outer bag 96 and being attached generally at areas 114 and 116. The inner liner top edge 95 is heat sealed and rigidly attached to the outer bag 96 generally at area 118. The heat seal type blanket seal is formed when the sealing band can transfer enough heat through the inner liner film to cause it to heat seal to the outer bag film. A sufficient amount of heat transfer from the sealing band is transferred if the sealing band temperature, heat capacity, and mass are sufficiently high, and the inner liner film is sufficiently thin and has a sufficiently low sealing temperature. Sealing band 112 may be made of the same materials described hereinbefore as useful for sealing band 100. The outer bag and inner materials as hereinafter described must be heat sealable to each other in order to form a heat seal type blanket seal. This so-called hinge type blanket seal is described in detail in U.S. Pat. No. 5,804,265 which has been incorporated by reference.

Generally, the outer support bag and inner liner of the multi-layered bags of the present invention are made from a thermoplastic material or a blend of thermoplastic materials and can be comprised of the same or different material. The films may be made by a conventional cast or blown film process. Useful thermoplastics include, for example, polyolefins such as high density polyethylene (HDPE), low density polyethylene (LDPE), linear low density polyethylene (LLDPE), and polypropylene (PP); thermoplastic elastomers such as styrenic block copolymers, polyolefin blends, elastomeric alloys, thermoplastic polyurethanes, thermoplastic copolyesters and thermoplastic polyamides; polymers and copolymers of polyvinyl chloride (PVC), polyvinylidene chloride (PVDC), saran polymers, ethylene/vinyl acetate copolymers, cellulose acetates, polyethylene terephthalate (PET), ionomer (Surlyn), polystyrene, polycarbonates, styrene acrylonitrile, aromatic polyesters, linear polyesters, thermoplastic polyvinyl alcohols and useful materials listed hereinbefore that may be used to make an inner film layer. Preferably, the outer support bag and the liner bag are both made of polyethylene and more preferably from a blend of low density polyethylene (LDPE) (about 0.92 density) and linear low density polyethylene (LLDPE) (about 0.925 density). Preferably, the inner liner film has a density of less than 0.930 g/cc.

Generally, the film of the inner liner has a Transverse Direction 2 Percent Secant Modulus (TDSM) of less than 40,000 pounds per square inch (psi) ($2.75\times10^8$ Pa) and preferably less than 27,000 psi ($1.86\times10^8$ Pa) as determined in accordance with ASTM D 832-83, Method A with a jaw gap of 4 inches, a specimen width of 1 inch, an initial strain rate of 0.25 inches/inch/minute, and a crosshead speed of 1 inch/minute. The modulus of a film in either the transverse or machine direction of the film is generally a measurement of the stiffness of the film. Typically, thermoplastic polyolefin films that are prepared by cast film processes that are known in the art have a TDSM of from about 20,000 to about 40,000 psi. Examples of commercially available resins that would result in cast or blown films having these tensile properties include, for example, LDPE 748 and LDPE 690 from The Dow Chemical Company.

Another useful characteristic of the film of the inner liner is the Z number as defined by the formula P×TDSM where t is the thickness of the film in mils and TDSM is the transverse direction modulus as defined above. The Z number describes the relative stiffness of the film as a function of the film's thickness and modulus. Generally, the inner liner has a Z number of less than 60,000 $mil^3$ psi. Preferably, the inner liner has a Z number of less than 20,000 $mil^3$ psi more preferably from about 2,000 to about 10,000 $mil^3$ psi and, even more preferably, from about 3,000 to about 6,000 $mil^3$ psi.

Preferably, the outer support bag has a Z value in a range of from about 50,000 to about 150,000 $mil^3$ psi 5.6 to 16.9 $mm^3$.kPa).

Generally, the outer support bag will have a nominal sidewall thickness of from about 1 to about 4 mils, preferably from about 1.3 to about 3.0 mils and, more preferably, from about 1.5 to about 2.0 mils. Nominal thickness refers to the thickness of the film prior to any surface treatment such as scoring, texturing, embossing and the like.

Generally, the inner liner will have a nominal sidewall thickness of from about 0.3 to about 1.0 mil and preferably has a nominal sidewall thickness of from about 0.5 to about 0.7 mil.

Preferably, the inner surface of the inner liner has a contact angle in the range of from 65° to 75° at 20° C. relative to raw beef meat juice as determined by advancing contact angle determination using a contact goniometer f, for example, Model No. A-100, available from Rame-Hart. Contact angle is defined as the angle formed between a horizontal substrate and a line tangent to the surface of a drop of liquid at the point where the surface of the liquid drop meet the horizontal substrate. The contact angle is a function of the surface tension of the liquid. The lower degree of contact angle indicates a higher degree of wetting or adhesion of the liquid to the substrate.

The method of measuring the contact angle is as follows: 1) drops of the liquid to be measured (about 1 microliter) are placed on the measuring surface (liner bag film) of the contact goniometer; 2) The contact angles are measured on both sides of each of five drops; 3) Step two is repeated on different sections of the inner surface and the results are averaged to determine a mean contact angle. Examples of film that have a contact angle of between 65° to 75° at 20° C. relative to a raw beef meat juice include a blend of LDPE and LLDPE available from The Dow Chemical Company.

The multi-layered bag of the present invention may also be made of films having different colors so to highlight the liner within a bag structure to the consumer. For example, the inner liner and support bag may be of a different color or tint or each or both may be opaque or clear.

The multi-layered bag of the present invention may also contain an inner liner and/or an outer bag that comprises a film or substrate that has been corona treated to improve the wetting characteristic of the film and thereby improve the meat adhering and/or printing characteristic of the film. Preferably, the inside surface or food contacting surface of the inner liner is corona treated. Useful teachings describing the process of corona treating plastic films are described in U.S. Pat. No. 5,328,705, incorporated herein by reference.

The multi-layered bags of the present invention may also have a printed area on the support and/or the inner liner. Printed areas are used as a write-on surface or a write-on patch to record information relating to the contents of the bag.

While not bound by any particular theory, it is believed that the means by which the multi-layered bags of the present invention prevent freezer burn of meats is that the inner liner film clings and conforms to the surface of the meat and therefore prevents moisture loss and excludes air from the meat surface. Excluding moisture loss and air from the meat surface reduces the formation of ice crystals that lead to freezer burn or dehydration of the meat.

Figure 7:
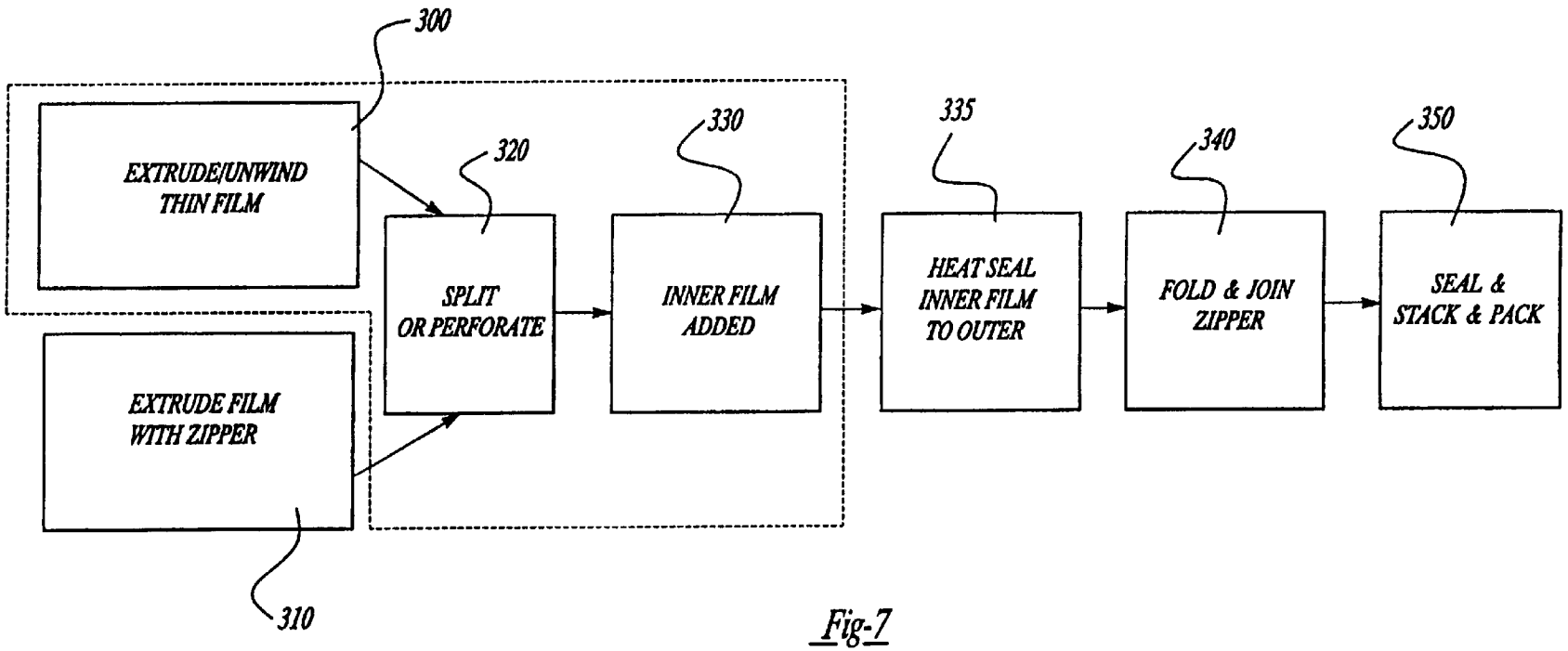
FIG. 7 is a diagrammatic flow diagram for a process of the present invention for making freezer bags having a common edge seal between the inner liner and the outer bag.

Referring to FIG. 7, a diagrammatic flow diagram for carrying out a process of manufacturing multi-layered bags in accordance with the teachings of the present invention is provided. As shown in the step illustrated by box 300, the inner liner film or second film (whether one sheet or multiple sheets) may be extruded or supplied from an unwind stand. Extrusion of the liner film may be by blown or cast extrusion of thermoplastic material as is known in the art. Step illustrated by box 310 provides that the support or first thermoplastic film is extruded having zipper type closure profiles on each respective film edge. The extrusion may be either convention cast or blown film. An example of an integral cast film process is described in U.S. Pat. No. 4,263,079, incorporated herein by reference. Preferably, both of the films are cast extruded.

Next, as illustrated by box 320, the inner film may be slit or perforated wherein the inner liner is formed from a single sheet. In the step illustrated by box 330, the inner or second film is added or overlaid onto the first film. The second film is aligned such that the edges of the second film are between the closure profiles of the first film. The overlaying and alignment of the second film onto the first film is done using conventional guide means such as rollers and nip rolls. In step illustrated by box 335, the parallel edges of the liner or second film are heat sealed to the support or first film. The films may be heat sealed together using conventional heat sealing means such as a heated bar sealer, a hot air sealer, extrusion lamination, heated rollers and belts and the like. In step illustrated by box 340, the attached films web is folded and the closure profiles are joined. The web may be folded by conventional folding means known in the art. In step illustrated by box 350, the folded film web is seal cut to form bags, the bags are stacked and the stacked bags are packed into a container. The attached films may be folded and seal cut into bags as described in U.S. Pat. No. 5,062,825, incorporated herein by reference. Preferably, the male and female closure elements are interlocked after folding of the films and prior to seal cutting. The finished bags may be stacked, delivered and then packed into containers as described in U.S. Pat. Nos. 5,302,080; 5,108,085 and 5,185,987, incorporated herein by reference.

Either one or both of the first and second films may be textured by, for example, embossing. Either or both of the film webs may be corona treated prior to or after being attached together. Preferably, the second thermoplastic film is corona treated and embossed prior to overlaying the second film onto the first thermoplastic film.

The second or liner film web may be perforated or slit prior to being overlaid onto the first or support film web using a process and an apparatus similar to that described in U.S. Pat. No. 5,405,561.

Figure 8:
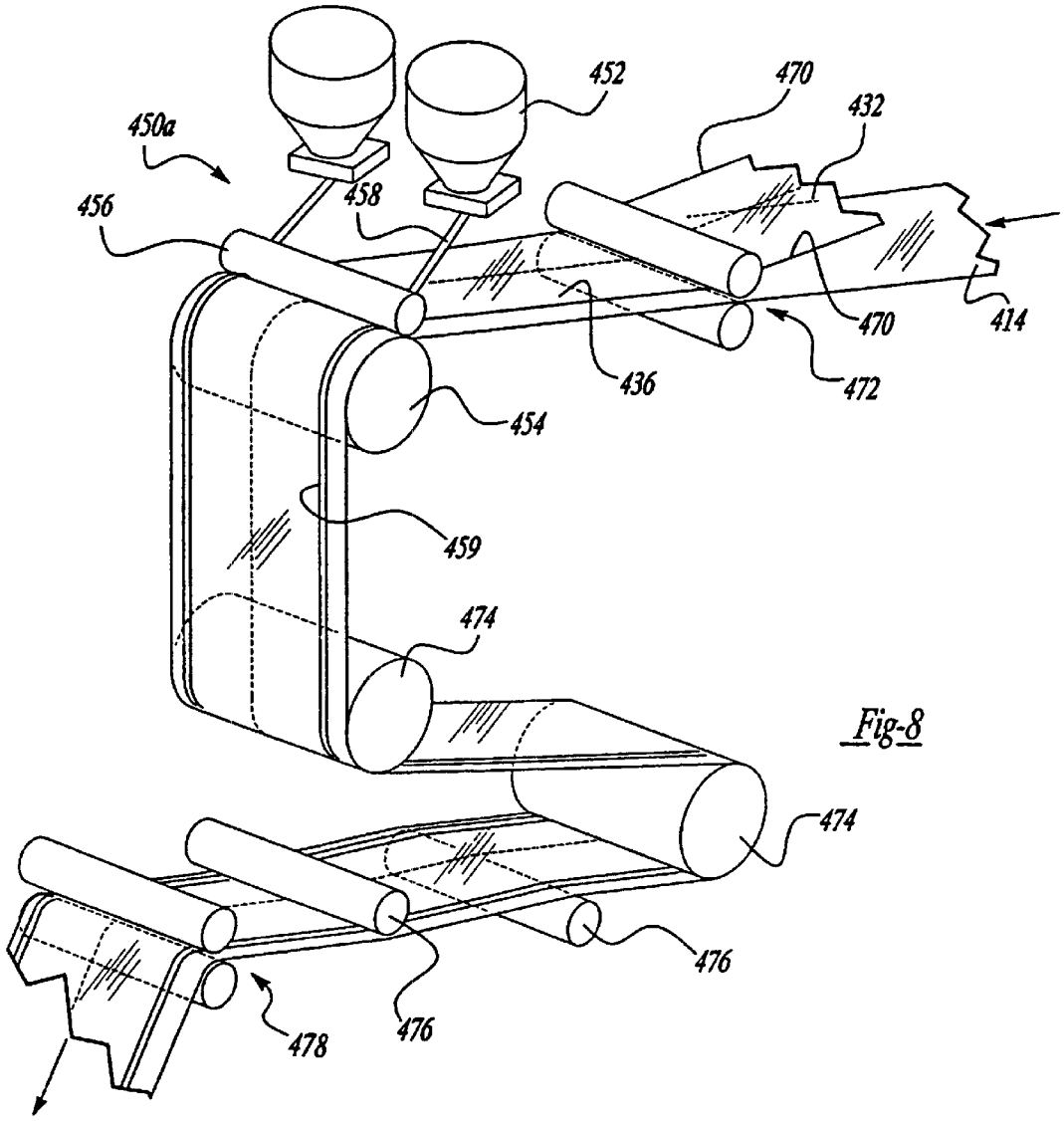
FIG. 8 is an isometric view of one process for preparing and blanket sealing multi-layered bags of the present invention.
Figure 9:
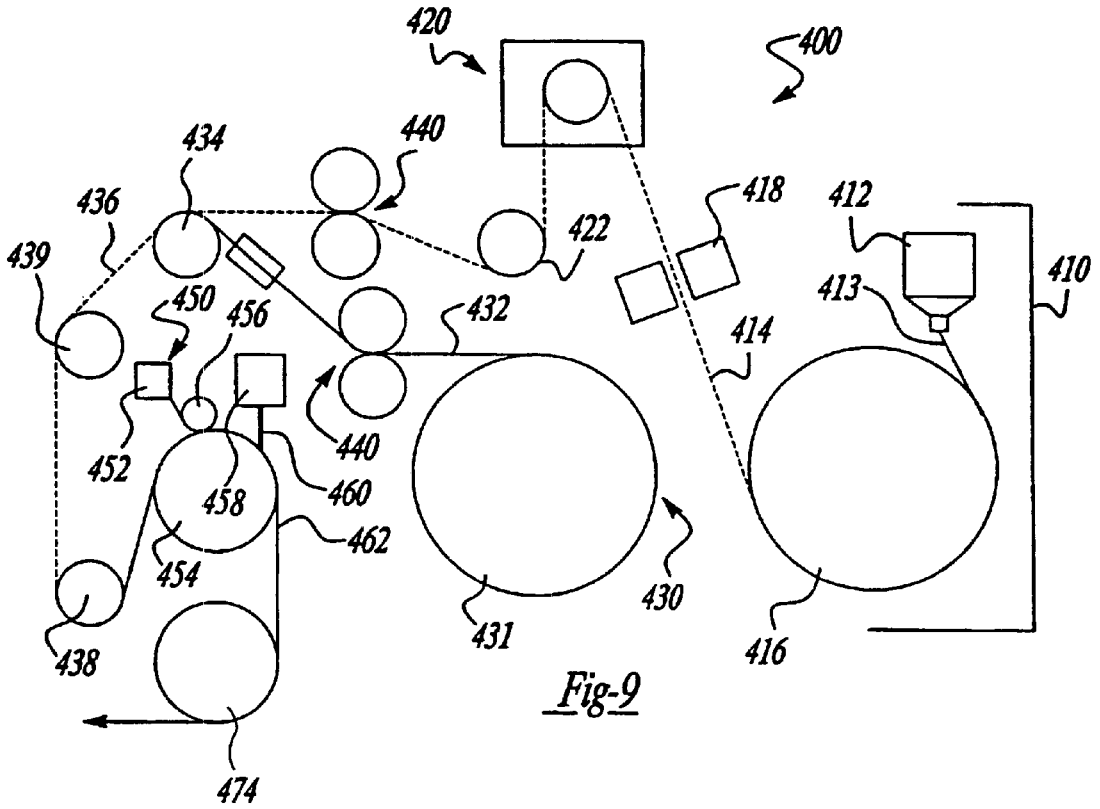
FIG. 9 is a cross-sectional view of a first apparatus of making the multi-layered bags of the present invention.

An apparatus 450*a* employed to carry out a preferred process for making the film web used for making multi-layered bags of the present invention is shown in FIG. 8 and an apparatus 400 for attaching the two film webs is shown in FIG. 9. FIG. 8 is a schematic side view of the process providing and attaching film webs 414 and 432 and FIG. 9 is an isometric view of a process for attaching the film webs together prior to forming bags. Hereinafter, due to the high degree of similarity in the apparatuses employed to form the multi-layered bags of the present invention, whenever possible, identical references numerals will be employed for identical components.

Referring to FIG. 9, process 400 generally comprises a means for providing a support or first film web 410, a means For providing a liner or second film web 430, tension control means 440, means for perforating or slitting the second film web at 460 and a sealing or attaching means shown generally as 450. Means 410 generally comprises an extrusion means 412 producing an extrusion 413 in extrusion alignment with a cast roll 416 to form a support or first film web 414. The means for providing the first film web may also be any means known in the art and may be an extrusion process as described in U.S. Pat. No. 5,049,223. Film web 414 passes through a conventional gauge control means 418 to a corona treatment means 420 wherein the first film web 414 is corona treated as described hereinbefore, to prepare the film for later optional printing, and film web 414 is then guided by roller 422 towards nip rolls 440.

A liner or second film web 432 is provided by a roll or unwind stand 431. The second film 432 may also be provided by a conventional blown or cast film process as is known in the art. The second film web has a transverse web width that is smaller than the transverse web width of the first film web 414. Film webs 414 and 432 are fed in to tension control means such as nip rolls 440 so as to match the strain of each of the films. Matching the strain of the films is described hereinafter in more detail.

While the second film web may be supplied in a pre-perforated roll as shown in FIG. 8, it is also possible to perforate or slit the web as it approaches nip rollers 472 as shown in other embodiments. The first and second film webs 414 and 432 are aligned and overlaid at roll 434 forming web 436. Web 436 is fed into a sealing means shown generally as 450. Web 436 changes orientation at roll 438, 439 and is fed into sealing means 450. Sealing means 450 generally comprises an extrusion means or extruder 452, roll 454 and compression roll 456. A preferred sealing means is shown in FIG. 8 and described below. Extruder 452 provides a sealing band 458. Sealing band 458 is fed onto web 436 and overlaps the parallel edge 470 of liner or second film 432. The sealing band 458 on web 436 passes between roll 454 and compression roll 456 and forming a blanket seal. Extrusion means or extruder 458 provides closure profiles 460. Closure profiles 460 are attached to the opposed parallel edges of the first film 414 as described in U.S. Pat. No. 5,049,223, forming a web having a blanket seal 459 and closure profiles then passes through conventional guide rolls 474 and 476 and nip rolls 478 (FIG. 8), and web 462. Web 462 having closure profiles is then folded, sealed and cut, stacked and packed as shown and described in FIG. 7. Either or both of the film webs may be textured or corona treated as described hereinbefore.

The second thermoplastic film or liner film may be attached to the first thermoplastic film or support film by means of an extruded blanket seal over or underlap the side edges of the liner film, hot air hem sealing, extrusion lamination (extruded thermoplastic film between the film layers), hot melt adhesive (placed over or under the edge of the top film layer), ultrasonic sealing, heated rollers or belts, adhesive film strips, infrared sealing, radio frequency sealing or vibration welding. Use of any of the above means of attaching two film webs largely depends on the chemical and physical characteristics of the film webs. Preferably, the liner film is attached to the support film using an extruded hinge type blanket seal 97 as shown in FIG. 5*c* and hereinafter described. The process shown in FIG. 7 may be a continuous process or a step process. Preferably, the process is continuous.

FIG. 10 shows a process for attaching the second thermoplastic film web 432 to the first thermoplastic film web 414 and is indicated generally as process 450*a*. Referring to FIG. 10 in attaching a second thermoplastic film web 432 to a first thermoplastic film web 414 along parallel edges 470 of the second thermoplastic film web 432 to a first thermoplastic film web 414 along parallel edges 470 of the second thermoplastic film web according to the present invention, the second thermoplastic film web 432 is aligned with and overlaid onto a first thermoplastic film web 414 forming film web 436. The film webs pass between nip rolls 472 and pass under a sealing band extruder 452. A sealing band 458 of molten thermoplastic material is extruded onto the advancing webs in the machine direction so as to overlap the edge 470 of the second film web and thereby contact and attach to both film webs securing the films together. The attached film webs are fed through a set of compression or pinch rolls 454, 456 forming a blanket seal 459. A conventional second sealing band extruder is used to seal the opposite parallel edge of the second film web to the first film web. Film web 436 having a blanket seal 459 then passes through conventional guide rolls 474 and 476 and nip rolls 478 so to orient the web 436 for folding and seal cutting to form bags.

Figure 5D:
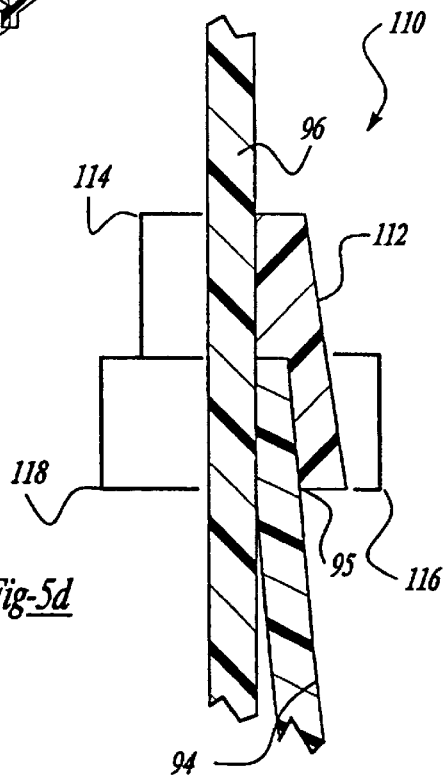
FIG. 5*d* is an enlarged cross-sectional view of another embodiment of a blanket seal for attaching the top edges of the liner bag to the sidewalls of the support bag.
Figure 6A:
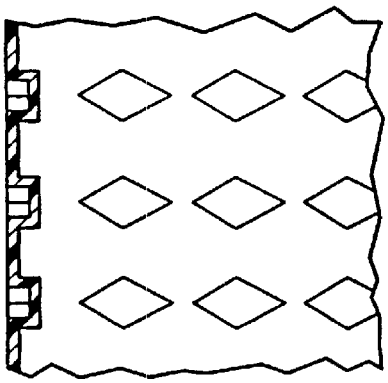
FIGS. 6*a*—6*f* are enlarged cross-sectional and plan views of various preferred embossing patterns for embossing the inner liner.
Figure 6B:
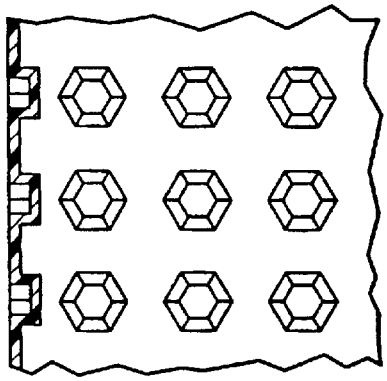
Figure 6C:
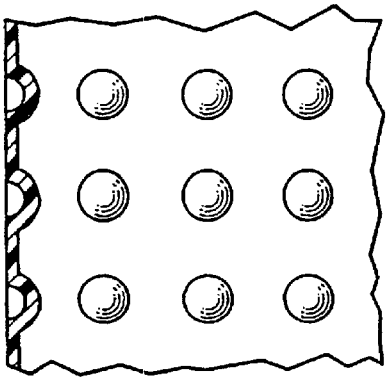
Figure 6D:
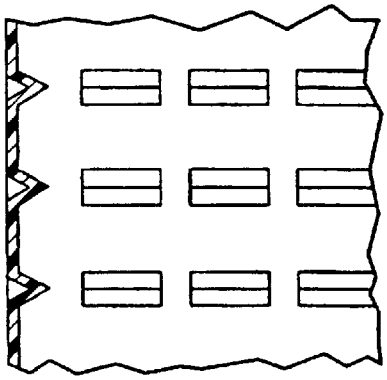
Figure 6E:
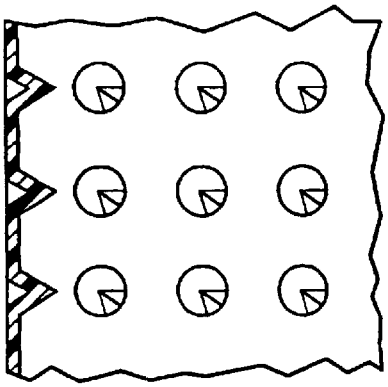
Figure 6F:
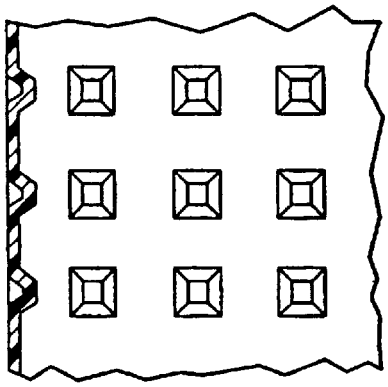

The blanket seal 459 may be either a hinge type blanket seal 97 (FIG. 5*c*) or a heat seal type blanket seal 110 (FIG. 5*d*). Some of the advantages of the blanket sealing process include films may be attached continuously at a relatively high process rate, the blanket seal appears strong and aesthetically pleasing to consumers, the process is insensitive to other process variations and it does not produce a film tail as does other processes known in the art.

Generally, the sealing bands may be applied in any fashion so as to attach the two films together. Preferably, the first thermoplastic film has mateable male and female closure elements along opposing edges of the film web and the sealing bands are applied equidistant from their respective closure profiles. More preferably, the sealing bands are applied equidistant from the respective edges of the first thermoplastic film such that mateable male and female closure elements may be applied to the support or first thermoplastic film after the film webs are attached.

Generally the sealing band may be made from any suitable thermoplastic material or combination of thermoplastic materials that are heat sealable to at least the portions of the thermoplastic films to be joined. Preferably, the sealing band is polyethylene and, more preferably, low density polyethylene. An example of a suitable commercially available LDPE useful in the present invention is LDPE 748, commercially available from the Dow Chemical Company.

When forming a hinge type blanket seal, the width of the sealing band may generally range from about 3 mm to the width of the support or first film web. Preferably, the width of the sealing band ranges from about 3 mm to about 76 mm and, more preferably, has a width of from about 6 mm to about 19 mm.

Generally, the sealing band used to form a hinge type blanket seal has a thickness of from about 13 microns to 254 microns (0.5 mil to 10 Mils) and preferably has a thickness of from about 25 microns to about 51 microns (1 mil to 2 mils) and more preferably from about 25.5 microns to about 38.2 microns (1.0 to 1.5 mils).

The sealing bands may be tinted, colored or textured so to highlight the liner within a bag structure to the consumer.

Since the sealing band normally does not heat seal the second film to the first film, the sealing band may advantageously be used to attach films that otherwise could not be heat sealed together. However, if the sealing band temperature, heat capacity and mass are sufficient and the liner film has an appropriate thickness and sealing temperature, the extruded sealing band will transfer enough heat through the liner film to heat seal it to the support film.

Generally, the width of the liner or second film web is less or smaller than the width of the first film web so that any portion of the seal band does not hang over the edge of the first film web after being applied. Preferably, the width of the liner or second film is smaller than that of the width of the first film such that male and female closure profiles may be attached along opposed parallel edges of the first film web.

Generally, it is known in the art that to attach two webs together, it is desirable to match the percent stretch or strain in the two webs at the point they are joined. Matching the strain avoids a cross direction curling (CD Curl) phenomenon from occurring when the tension is released. In the machine direction, the tension in each web can be related as follows:

In the elastic region:

$$o = Ee = \frac{T}{t}$$

Where:

o=stress (psi)

E=modulus of elasticity (psi)

e=strain (in/in)

T=tension (PLI)

t=thickness (in)

Rearranging gives:

$$\epsilon = \frac{o}{E} = \frac{T}{tE}$$

To avoid machine direction (MD) puckering when an inner liner film is attached to an outer film.

$$\text{Set } \epsilon_{Liner} = \epsilon_{Outer\ film}$$

$$T_{Liner} = T_{Outer} \cdot \frac{t_{Liner} \cdot E_{Liner}}{t_{Outer} \cdot E_{Outer}}$$

For elastic films, it is known in the art that a material under tension in the machine direction will contract or "neck in" in the cross direction as a function of a material property known as Poisson's ration v. Poisson's ratio is a ratio of lateral strain to axial strain and is typically about 0.3 for polyethylene. Using Poisson's ratio to relate the lateral strain to the axial strain and following a similar derivation as above, the conditions required to match CD strain and avoid MD curl is as follows:

$$T_{Liner} = T_{Outer} \cdot \left[\frac{V_{outer} \cdot t_{Liner} \cdot E_{Liner}}{V_{Liner} \cdot t_{Outer} \cdot E_{Outer}}\right]$$

In practice, it is generally desirable to match the strain in both the machine and cross directions. The puckering can be minimized by a variety of means, including attaching webs that are similar in modulus and/or attaching webs that are similar in Poisson's ratio.

For a given set of materials, the puckering can be minimized by running at low tension where the films are attached so there will be less recovery. Depending on the application, the cross direction puckering can sometimes be considered insignificant compared to the machine direction.

Thus, it is desirable to maintain a relatively low tension in both webs and have matched machine direction strain in the webs at the point where they are joined. It is generally known in the art that a recommended tension in the machine direction range to effectively transport webs is from 10–25% of the yield tension, measured in PLL film tracking may become less precise at tensions below 10% of the yield tension. While the MD tension in each web can be maintained from 0–100% of the yield point, it has been found that above 25% of the yield point, there is a danger of localized thin spots in the web actually exceeding the yield point of the film, resulting in non-elastic stretching. It has been found that for successful attachment of extruded sealing bands, the tension is preferably run in the range of 2–15% of the yield tension in the machine direction.

For the preferred embodiment, it has been found advantageous to use lightweight idler rolls with low friction bearings, to minimize the drag between the liner film supply point and the point where a blanket seal is applied. Even then, the tension in the liner film at the supply point is often so low that there becomes a trade off between low enough tension to avoid puckering or stretching and high enough tension for adequate tracking. As a result, the embodiment shown in FIG. 8 has a set of nip rolls 472 between the two web supply points and the point where a blanket seal is applied. Then the tension in the two webs can be matched at somewhat higher, for example, 15% of the yield point tension prior to the nip rolls. Nip rolls allow different tension control zones. The strain in the webs can be matched by appropriate tension control between the supply points and the nip roll. The compression roll is run at slightly lower speed than the nip rolls so to release some of the MD tension, reducing it to the desired 2–15% range for blanket band sealing. A second set of nip rolls could optionally be added such that each web would run through a separate nip and could have separate tension control just prior to joining of the separate film webs as shown in FIG. 9.

Referring back to the process shown in FIG. 9, the tension of the liner or second thermoplastic film is generally controlled in the range of from about 0.05 to about 1 pound per linear inch width (PLI) (0.6 mil PE) by using a set of compressing or nip rollers 440 as is known in the art. In the preferred embodiment, each of the film webs pass through nip rolls so to match the strain on each of the films. Thus, the tension of each of the film webs may be different in order to match the strain on each of the films. Alignment of the liner or second film may be accomplished by using conventional edge guiding systems and/or edge trimming of the film web to width.

Referring again to FIG. 8, the tension of the combined films is generally controlled in the range of from about 0.02 to about 2.0 PLI (PE films) after the sealing band is applied to avoid stretching of the warm bands. The tension of the combined film webs may be controlled by conventional nip rollers 472 and 478. Stretching of the blanket bands may produce a "wave" and/or puckering in the final product.

Referring to FIG. 10, an alternate process according to the present invention for heat sealing at least two film webs comprises the steps of providing at least first and second film webs capable of being heat sealed together, overlaying the second film web onto the first film web, providing at least one sealing band of material having a temperature, mass and heat capacity sufficient to heat seal the second thermoplastic film to the first thermoplastic film and applying the band of sealing material to the overlaid film webs. This process is the same as the process shown in FIG. 8 except that the sealing band extruder 452 may be placed above any portion of the film web 436 so to heat seal the film webs together in the machine direction at any point across the web. Preferably, the sealing band is compressed between rollers 454, 456 after having been applied. Multiple sealing band extruders 452 are used to provide multiple sealing bands 458 along the machine direction of the film web so as to form multiple heat seal type blanket bands as shown, for example, in FIG. 8. The film webs may be provided by extrusion or from an unwind stand. The film webs to be heat sealed may be made of any thermoplastic materials capable of being heat sealed together including those materials described hereinbefore. The film webs may have the same width or be of different widths. Generally, the sealing band may be made of any extrudable material capable of heat sealing to film webs together. Preferably, the sealing band is made from thermoplastic materials including, for example, LDPE 748, available from The Dow Chemical Company.

Generally, the sealing band has a temperature, heat capacity and mass sufficient to heat seal two films together. Generally, the temperature of the sealing band is the temperature at which the particular material may be extruded without degrading.

Generally, the thickness of the film to be heat sealed should be of a thickness SO as to allow heat transfer from the sealing band to the film to heat seal the film to the underlying film web. Generally, the thickness of the sealing band used to form a heat seal type blanket seal may range from about 0.5 mil to about 10 mils. Preferably, the sealing band for a heat seal type blanket seal has a thickness of from about 1.5 mils to about 3.0 mils and, more preferably, has a thickness of from about 1.5 mils to about 2 mils.

Figure 8A:
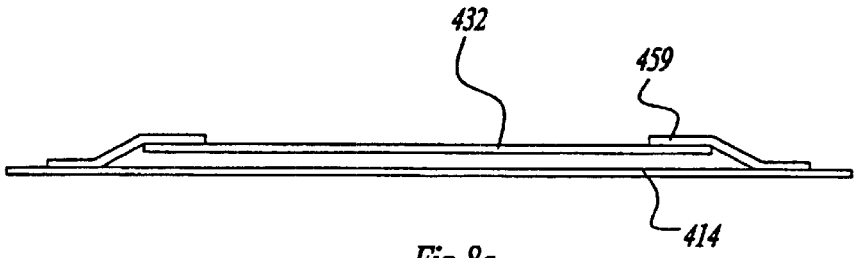
FIG. 8*a* is a sectional view of the multi-layered bag panel produced in the apparatus of FIG. 8.

Generally, the width of the sealing band used to form a heat seal type blanket seal ranges from about 3 mm to the width of the support or first film web, preferably the width of the sealing band ranges from about 3 mm to about 76 mm and, more preferably, has a width of from about 6 mm to about 19 mm. As shown in the sectional view of FIG. 8*a*, the second film 432 of the resulting panel is bonded underneath the respective blanket seals 459.

Figure 12:
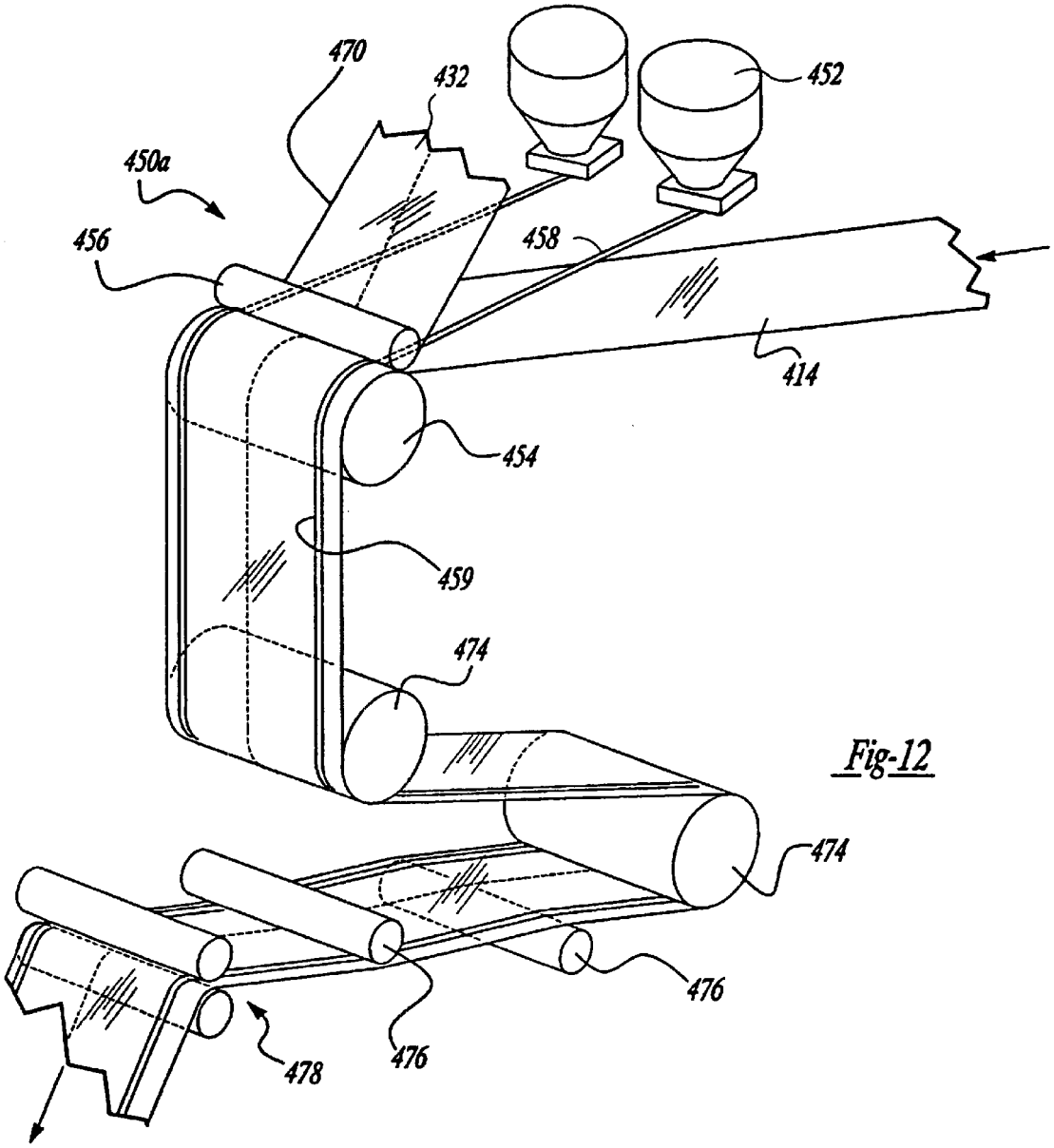
FIG. 12 is an isometric view of a further apparatus for preparing and blanket sealing a multi-layered bag of the present invention.

Referring to FIG. 12, another process according to the present invention for attaching at least two film webs using apparatus 450*a* comprises the steps of providing at least a first film web 414 and a second film web 432 having first and second widths respectively, the second width being smaller than the first width, optionally perforating or slitting the second film, overlaying the second film web onto the first film web between parallel edges of the first film web, providing at least one band of sealing material 458 and applying said band of sealing material along and over parallel edges 470 of the second film web. Preferably, the sealing band 458 is applied to the fill webs by one or more extruders 452. Extruders 452 may be placed at any point above the film webs so to be capable of attaching the film webs together by forming a hinge type blanket seal 459 in the machine direction. For example, multiple extruders 452 may be staggered above the parallel edges of three or more film webs so to attach the film webs together in succession. Preferably, the sealing band 458 is compressed between rollers 454, 456 after having been applied to the parallel edges of the film web or webs, and then the film web or webs pass through conventional guide rolls 474 and 476 and nip rolls 478.

Preferably, the sealing bands 458 used to form hinge type blanket seals are applied equidistant from the respective edges of the first thermoplastic film. Generally, the sealing band may be made from any suitable thermoplastic material or combination of thermoplastic materials that are heat sealable to at least the portions of the film webs to be joined. The film webs to be joined may be, for example, thermoplastic as described hereinbefore, non-thermoplastic, fabrics, non-woven, co-extruded films and the like. The film substrates are attached together by the sealing band as shown in FIG. 5*c*.

When forming a hinge type blanket seal, the width of the sealing band may generally range from about 3 mm to the width of the support or first film web, preferably the width of the sealing band ranges from about 3 mm to about 76 mm and, more preferably, has a width of from about 6 mm to about 19 mm.

Generally, the sealing band used to form a hinge type blanket seal has a thickness of from about 13 microns to about 254 microns (0.5 mil to 10 mils) and, preferably, has a thickness of from about 25 microns to about 51 microns (1 mil to 2 mils) and, more preferably, from about 25.5 microns to about 38.2 microns (1.0 mil to 1.5 mils).

Referring to FIGS. 10, 10*a* and 10*b*, the multi-layered bag is substantially similar to that of FIG. 8 except that the inner liner 432 is in the form of a single perforated sheet having an enlarged web width. The sheet or film, as it is otherwise referred to, is folded over as it advances through rollers 472 to be subsequently torn along the perforations.

Referring to FIGS. 11, 11*a* and 11*b* (reference numbers identify the same components as in FIG. 8), the main difference between this and other embodiments shown is that the inner liner is formed from two separate and distinct sheet rolls rather than a single sheet which is perforated or slit. As the two sheets are advanced through nip rolls 472, the sheets are overlapped as demonstrated most clearly in FIG. 11*b*.

Figure 12A:
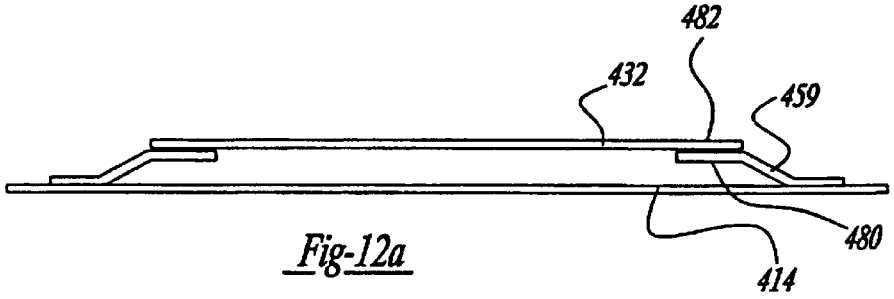
FIG. 12*a* is a sectional view of the multi-layered bag panel produced via the apparatus of FIG. 12.

Finally, as illustrated in FIGS. 12 and 12*a*, although preferable in terms of bag strength, it is entirely possible to adhere the inner sheet(s) to the outer surfaces 482 of blanket seals 459 rather than the inner surface 480 as is normally done when blanket seals are employed in lieu of heat sealing or other previously enumerated sealing techniques.

While it will be apparent that the preferred embodiments of the invention disclosed are well calculated to fulfill the objects stated, it will be appreciated that the invention is susceptible to modification, variation and change without departing from the spirit thereof.

What is claimed is:

1. A multi-layered bag comprising:

an outer bag comprising two opposing sidewalls, each opposing sidewall having (i) an inner surface and an outer surface, (ii) a first lateral edge and a second lateral edge, and (iii) a first longitudinal edge and a second longitudinal edge, the first longitudinal edge and the second longitudinal edge of each opposing sidewall being attached together, the second lateral edge of each opposing sidewall being attached together, the first lateral edge of each opposing sidewall forming an opening to said outer bag; and at least one inner liner having (i) a first lateral edge and a second lateral edge and (ii) a first longitudinal edge and a second longitudinal edge, wherein (i) the first lateral edge of said at least one inner liner is attached to the inner surface of at least one of said opposing sidewalls, (ii) the first longitudinal edge of said at least one inner liner is substantially parallel to the first longitudinal edge of each opposing sidewall, (iii) the second longitudinal edge of said at least one inner liner is substantially parallel to the second longitudinal edge of each opposing sidewall, (iv) each of the first and second longitudinal edges of said at least one inner liner extends from the first lateral edge of said at least one inner liner to the second lateral edge of said at least one inner liner, (v) the second lateral edge of said at least one inner liner is substantially parallel to the first lateral edge of said at least one inner liner, (vi) the second lateral edge of said at least one inner liner is free standing, and (vii) a nominal thickness of said at least one inner liner is from 0.3 mil to 1.0 mil.

2. A multi-layered bag according to claim 1, wherein the attachment of the first lateral edge of said at least one inner liner is spaced from the opening of said multi-layered bag.

3. A multi-layered bag according to claim 1, wherein said at least one inner liner comprises a thermoplastic film having a Transverse Direction Secant Modulus (TDSM) of less than 40,000 psi when determined in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

4. A multi-layered bag according to claim 3, wherein said at least one inner liner comprises a thermoplastic film having a Z number of less than 60,000 $mil^3$ psi wherein Z is $(t^3)\times(TDSM)$ where t is a thickness of the film in mils and TDSM is a transverse direction secant modulus in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

5. A multi-layered bag according to claim 4, wherein the Z number of said at least one inner liner is less than 20,000 $mil^3$ psi.

6. A multi-layered bag according to claim 4, wherein said outer bag comprises a film having a Z value in a range of from 50,000 $mil^3$ psi to 150,000 $mil^3$ psi.

7. A multi-layered bag according to claim 6, wherein the thermoplastic film comprises homopolymers and copolymers of ethylene.

8. A multi-layered bag according to claim 1, wherein the first lateral edge of said at least one inner liner is attached to the inner surface of at least one of said opposing sidewalls by a hinge-type blanket seal or a heat-seal-type blanket seal.

9. A multi-layered bag according to claim 1, wherein the first lateral edge of said at least one inner liner is attached to at least one opposing sidewall of said outer bag by hot melt adhesive or a hot air hem seal.

10. A multi-layered bag according to claim 1, wherein said at least one inner liner is textured.

11. A multi-layered bag according to claim 1, wherein said outer bag comprises mateable male and female closure elements.

12. A multi-layered bag according to claim 1, wherein the first and second longitudinal edges of said at least one inner liner are respectively attached to the first and second longitudinal edges of each opposing sidewall.

13. A multi-layered bag according to claim 1, wherein the first lateral edge of said at least one inner liner is attached to the inner surface of at least one of said opposing sidewalls by a blanket seal.

14. A multi-layered bag according to claim 1, wherein an inner surface of said at least one inner liner is corona treated.

15. A multi-layered bag according to claim 1, wherein at least one of the first longitudinal edge and the second longitudinal edge of said at least one inner liner is spaced apart from the respective first longitudinal edge or second longitudinal edge of each opposing sidewall of said outer bag.

16. A multi-layered bag according to claim 1, wherein a color of said at least one inner liner is different than a color of at least a portion of said outer bag.

17. A multi-layered bag comprising:

an outer bag comprising two opposing sidewalls, each opposing sidewall having (i) an inner surface and an outer surface, (ii) a first lateral edge and a second lateral edge, and (iii) a first longitudinal edge and a second longitudinal edge, the first longitudinal edge and the second longitudinal edge of each opposing sidewall being attached together, the second lateral edge of each opposing sidewall being attached together, the first lateral edge of each opposing sidewall forming an opening to said outer bag; and at least one inner liner having (i) a first lateral edge and a second lateral edge and (ii) a first longitudinal edge and a second longitudinal edge, wherein (i) the first lateral edge of said at least one inner liner is attached to the inner surface of at least one of said opposing sidewalls, (ii) the first longitudinal edge of said at least one inner liner is substantially parallel to the first longitudinal edge of each opposing sidewall, (iii) the second longitudinal edge of said at least one inner liner is substantially parallel to the second longitudinal edge of each opposing sidewall, (iv) each of the first and second longitudinal edges of said at least one inner liner extends from the first lateral edge of said at least one inner liner to the second lateral edge of said at least one inner liner, (v) the second lateral edge of said at least one inner liner is substantially parallel to the first lateral edge of said at least one inner liner, (vi) the second lateral edge of said at least one inner liner is free standing, and (vii) said at least one inner liner is textured.

18. The multi-layered bag according to claim 17, wherein the attachment of the first lateral edge of said at least one inner liner is spaced from the opening of said multi-layered bag.

19. A multi-layered bag according to claim 17, wherein said at least one inner liner comprises a thermoplastic film having a Transverse Direction Secant Modulus (TDSM) of less than 40,000 psi when determined in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

20. A multi-layered bag according to claim 19, wherein said at least one inner liner comprises a thermoplastic film having a Z number of less than 60,000 $mil^3$ psi wherein Z is $(t^3)\times(TDSM)$ where t is a thickness of the film in mils and TDSM is a transverse direction secant modulus in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

21. A multi-layered bag according to claim 20, wherein the Z number of said at least one inner liner is less than 20,000 $mil^3$ psi.

22. A multi-layered bag according to claim 20, wherein said outer bag comprises a film having a Z value in a range of from 50,000 $mil^3$ psi to 150,000 $mil^3$ psi.

23. A multi-layered bag according to claim 22, wherein the thermoplastic film comprises homopolymers and copolymers of ethylene.

24. A multi-layered bag according to claim 17, wherein the first lateral edge of said at least one inner liner is attached to the inner surface of at least one of said opposing sidewalls by a hinge-type blanket seal or a heat-seal-type blanket seal.

25. A multi-layered bag according to claim 17, wherein said outer bag comprises mateable male and female closure elements.

26. A multi-layered bag according to claim 17, wherein the first and second longitudinal edges of said at least one inner liner are respectively attached to the first and second longitudinal edges of each opposing sidewall.

27. A multi-layered bag according to claim 17, wherein the first lateral edge of said at least one inner liner is attached to the inner surface of at least one of said opposing sidewalls by a blanket seal.

28. A multi-layered bag according to claim 17, wherein an inner surface of said at least one inner liner is corona treated.

29. A multi-layered bag according to claim 17, wherein at least one of the first longitudinal edge and the second longitudinal edge of said at least one inner liner is spaced apart from the respective first longitudinal edge or second longitudinal edge of each opposing sidewall of said outer bag.

30. A multi-layered bag according to claim 17, wherein the first lateral edge of said at least one inner liner is attached to at least one opposing sidewall of said outer bag by hot melt adhesive or a hot air hem seal.

31. A multi-layered bag according to claim 17, wherein a color of said at least one inner liner is different than a color of at least a portion of said outer bag.

32. A multi-layered bag comprising:

an outer bag comprising two opposing sidewalls, each opposing sidewall having (i) an inner surface and an outer surface, (ii) a first lateral edge and a second lateral edge, and (iii) a first longitudinal edge and a second longitudinal edge, the first longitudinal edge and the second longitudinal edge of each opposing sidewall being attached together, the second lateral edge of each opposing sidewall being attached together, the first lateral edge of each opposing sidewall forming an opening to said outer bag; and at least one inner liner having (i) a first lateral edge and a second lateral edge and (ii) a first longitudinal edge and a second longitudinal edge, wherein (i) the first lateral edge of said at least one inner liner is attached to the inner surface of at least one of said opposing sidewalls, (ii) the first longitudinal edge of said at least one inner liner is substantially parallel to the first longitudinal edge of each opposing sidewall, (iii) the second longitudinal edge of said at least one inner liner is substantially parallel to the second longitudinal edge of each opposing sidewall, (iv) each of the first and second longitudinal edges of said at least one inner liner extends from the first lateral edge of said at least one inner liner to the second lateral edge of said at least one inner liner, (v) the second lateral edge of said at least one inner liner is substantially parallel to the first lateral edge of said at least one inner liner, (iv) the second lateral edge of said at least one inner liner is free standing, and (vii) said outer bag comprises mateable male and female closure elements.

33. A multi-layered bag according to claim 32, wherein the first and second longitudinal edges of said at least one inner liner are respectively attached to the first and second longitudinal edges of each opposing sidewall.

34. A multi-layered bag according to claim 33, wherein the first lateral edge of said at least one inner liner is attached to the inner surface of at least one of said opposing sidewalls by a blanket seal.

35. A multi-layered bag according to claim 34, wherein an inner surface of said at least one inner liner is corona treated.

36. A multi-layered bag according to claim 32, wherein the attachment of the first lateral edge of said at least one inner liner is spaced from the opening of said multi-layered bag.

37. A multi-layered bag according to claim 32, wherein said at least one inner liner comprises a thermoplastic film having a Transverse Direction Secant Modulus (TDSM) of less than 40,000 psi when determined in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

38. A multi-layered bag according to claim 37, wherein said at least one inner liner comprises a thermoplastic film having a Z number of less than 60,000 $mil^3$ psi wherein Z is $(t^3)\times(TDSM)$ where t is a thickness of the film in mils and TDSM is a transverse direction secant modulus in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

39. A multi-layered bag according to claim 38, wherein said outer bag comprises a film having a Z value in a range of from 50,000 $mil^3$ psi to 150,000 $mil^3$ psi.

40. A multi-layered bag according to claim 39, wherein the thermoplastic film comprises homopolymers and copolymers of ethylene.

41. A multi-layered bag according to claim 38, wherein the Z number of said at least one inner liner is less than 20,000 $mil^3$ psi.

42. A multi-layered bag according to claim 32, wherein the first lateral edge of said at least one inner liner is attached to the inner surface of at least one of said opposing sidewalls by a hinge-type blanket seal or a heat-seal-type blanket seal.

43. A multi-layered bag according to claim 32, wherein at least one of (i) the first longitudinal edge and (ii) the second longitudinal edge of said at least one inner liner is spaced apart from the respective first longitudinal edge or second longitudinal edge of each opposing sidewall of said outer bag.

44. A multi-layered bag according to claim 32, wherein the first lateral edge of said at least one inner liner is attached to at least one opposing sidewall of said outer bag by hot melt adhesive or a hot air hem seal.

45. A multi-layered bag according to claim 32, wherein a color of said at least one inner liner is different than a color of at least a portion of said outer bag.

46. A multi-layered bag comprising:

an outer bag comprising two opposing sidewalls, each opposing sidewall having (i) an inner surface and an outer surface, (ii) a first lateral edge and a second lateral edge, and (iii) a first longitudinal edge and a second longitudinal edge, the first longitudinal edge and the second longitudinal edge of each opposing sidewall being attached together, the second lateral edge of each opposing sidewall being attached together, the first lateral edge of each opposing sidewall forming an opening to said outer bag; and at least one inner liner having (i) a first lateral edge and a second lateral edge and (ii) a first longitudinal edge and a second longitudinal edge, wherein (i) the first lateral edge of said at least one inner liner is attached to the inner surface of at least one of said opposing sidewalls, (ii) the first longitudinal edge of said at least one inner liner is substantially parallel to the first longitudinal edge of each opposing sidewall, (iii) the second longitudinal edge of said at least one inner liner is substantially parallel to the second longitudinal edge of each opposing sidewall, (iv) each of the first and second longitudinal edges of said at least one inner liner extends from the first lateral edge of said at least one inner liner to the second lateral edge of said at least one inner liner, (v) the second lateral edge of said at least one inner liner is substantially parallel to the first lateral edge of said at least one inner liner, (vi) the second lateral edge of said at least one inner liner is free standing, and (vii) at least one of the first longitudinal edge and the second longitudinal edge of said at least one inner liner is spaced apart from the respective first longitudinal edge or second longitudinal edge of each opposing sidewall of said outer bag.

47. A multi-layered bag according to claim 46, wherein the attachment of the first lateral edge of said at least one inner liner is spaced from the opening of said multi-layered bag.

48. A multi-layer bag according to claim 46, wherein said at least one inner liner comprises a thermoplastic film having a Transverse Direction Secant Modulus (TDSM) of less than 40,000 psi when determined in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

49. A multi-layered bag according to claim 48, wherein said at least one inner liner comprises a thermoplastic film having a Z number of less than 60,000 $mil^3$ psi wherein Z is $(t^3)\times(TDSM)$ where t is a thickness of the film in mils and TDSM is a transverse direction secant modulus in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

50. A multi-layered bag according to claim 49, wherein the Z number of said at least one inner liner is less than 20,000 $mil^3$ psi.

51. A multi-layered bag according to claim 49, wherein said outer bag comprises a film having a Z value in a range of from 50,000 $mil^3$ psi to 150,000 $mil^3$ psi.

52. A multi-layered bag according to claim 51, wherein the thermoplastic film comprises homopolymers and copolymers of ethylene.

53. A multi-layered bag according to claim 46, wherein the first lateral edge of said at least one inner liner is attached to the inner surface of at least one of said opposing sidewalls by a hinge-type blanket seal or a heat-seal-type blanket seal.

54. A multi-layered bag according to claim 46, wherein the first lateral edge of said at least one inner liner is attached to the inner surface of at least one of said opposing sidewalls by a blanket seal.

55. A multi-layered bag according to claim 46, wherein an inner surface of said at least one inner liner is corona treated.

56. A multi-layered bag according to claim 46, wherein the first lateral edge of said at least one inner liner is attached to at least one opposing sidewall of said outer bag by hot melt adhesive or a hot air hem seal.

57. A multi-layered bag according to claim 46, wherein a color of said at least one inner liner is different than a color of at least a portion of said outer bag.

58. A multi-layered bag comprising:

an outer bag comprising two opposing sidewalls, each opposing sidewall having (i) an inner surface and an outer surface, (ii) a first lateral edge and a second lateral edge, and (iii) a first longitudinal edge and a second longitudinal edge, the first longitudinal edge and the second longitudinal edge of each opposing sidewall being attached together, the second lateral edge of each opposing sidewall being attached together, the first lateral edge of each opposing sidewall forming an opening to said outer bag; and at least one inner liner having (i) a first lateral edge and a second lateral edge and (ii) a first longitudinal edge and a second longitudinal edge, wherein (i) the first lateral edge of said at least one inner liner is attached to the inner surface of at least one of said opposing sidewalls, (ii) the first longitudinal edge of said at least one inner liner is substantially parallel to the first longitudinal edge of each opposing sidewall, (iii) the second longitudinal edge of said at least one inner liner is substantially parallel to the second longitudinal edge of each opposing sidewall, (iv) each of the first and second longitudinal edges of said at least one inner liner extends from the first lateral edge of said at least one inner liner to the second lateral edge of said at least one inner liner, (v) the second lateral edge of said at least one inner liner is substantially parallel to the first lateral edge of said at least one inner liner, (vi) the second lateral edge of said at least one inner liner is free standing, and (vii) a color of said at least one inner liner is different than a color or at least a portion of said outer bag.

59. A multi-layered bag according to claim 58, wherein the attachment of the first lateral edge of said at least one inner liner is spaced from the opening of said multi-layered bag.

60. A multi-layered bag according to claim 58, wherein said at least one inner liner comprises a thermoplastic film having a Transverse Direction Secant Modulus (TDSM) of less than 40,000 psi when determined in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

61. A multi-layered bag according to claim 60, wherein said at least one inner liner comprises a thermoplastic film having a Z number of less than 60,000 $mil^3$ psi wherein Z is $(t^3)\times(TDSM)$ where t is a thickness of the film in mils and TDSM is a transverse direction secant modulus in accordance with ASTM D 832-83, Method A, having a jaw gap of 4 inches for specimens having a 1 inch width, except that the Initial Strain Rate is 0.25 inches per inch per minute with a crosshead speed of 1 inch per minute.

62. A multi-layered bag according to claim 61, wherein the Z number of said at least one inner liner is less than 20,000 $mil^3$ psi.

63. A multi-layered bag according to claim 61, wherein said outer bag comprises a film having a Z value in a range of from 50,000 $mil^3$ psi to 150,000 $mil^3$ psi.

64. A multi-layered bag according to claim 63, wherein the thermoplastic film comprises homopolymers and copolymers of ethylene.

65. A multi-layered bag according to claim 58, wherein the first lateral edge of said at least one inner liner is attached to the inner surface of at least one of said opposing sidewalls by a hinge-type blanket seal or a heat-seal-type blanket seal.

66. A multi-layered bag according to claim 58, wherein the first and second longitudinal edges of said at least one inner liner are respectively attached to the first and second longitudinal edges of each opposing sidewall.

67. A multi-layered bag according to claim 58, wherein the first lateral edge of said at least one inner liner is attached to the inner surface of at least one of said opposing sidewalls by a blanket seal.

68. A multi-layered bag according to claim 58, wherein an inner surface of said at least one inner liner is corona treated.

69. A multi-layered bag according to claim 58, wherein the first lateral edge of said at least one inner liner is attached to at least one opposing sidewall of said outer bag by hot melt adhesive or a hot air hem seal.

70. A multi-layered bag comprising:

an outer bag comprising two opposing sidewalls, each opposing sidewall having (i) an inner surface and an outer surface, (ii) a first lateral edge and a second lateral edge, and (iii) a first longitudinal edge and a second longitudinal edge, the first longitudinal edge and the second longitudinal edge of each opposing sidewall being attached together, the second lateral edge of each opposing sidewall being attached together, the first lateral edge of each opposing sidewall forming an opening to said outer bag; and at least one inner liner comprising two opposing sheets, each opposing sheet having (i) an inner surface and an outer surface, (ii) a first lateral edge and a second lateral edge, and (iii) a first longitudinal edge and a second longitudinal edge, wherein (i) the first lateral edge of each opposing sheet of said at least one inner liner is respectively attached to the inner surface of each opposing sidewall of said outer bag, (ii) the first longitudinal edge of each opposing sheet is substantially parallel to the first longitudinal edge of each opposing sidewall, (iii) the second longitudinal edge of each opposing sheet is substantially parallel to the second longitudinal edge of each opposing sidewall, (iv) each of the first and second longitudinal edges of each opposing sheet extends from the first lateral edge to the second lateral edge of each opposing sheet, (v) the second lateral edge of each opposing sheet is substantially parallel to the first lateral edge of each opposing sheet, (vi) the second lateral edges of the two opposing sheets are separably joined to each other, and (vii) the first and second longitudinal edges of said at least one inner liner each extend substantially the length of said multi-layered bag.

* * * * *

UNITED STATES PATENT AND TRADEMARK OFFICE

CERTIFICATE OF CORRECTION

PATENT NO. : 6,371,643 B2
APPLICATION NO. : 09/324474
DATED : April 16, 2002
INVENTOR(S) : Zain E. M. Saad et al.

It is certified that error appears in the above-identified patent and that said Letters Patent is hereby corrected as shown below:

Column 20, Line 7: replace "(iv)" with --(vi)--

Signed and Sealed this

Fourth Day of November, 2008

JON W. DUDAS
*Director of the United States Patent and Trademark Office*